US007116928B2

(12) United States Patent
Muramatsu et al.

(10) Patent No.: US 7,116,928 B2
(45) Date of Patent: Oct. 3, 2006

(54) POWDER DISCHARGING DEVICE AND IMAGE FORMING APPARATUS USING THE SAME

(75) Inventors: Satoshi Muramatsu, Tokyo (JP); Nobuo Kasahara, Kanagawa (JP); Nobuo Iwata, Kanagawa (JP); Junichi Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 120 days.

(21) Appl. No.: 10/738,028

(22) Filed: Dec. 18, 2003

(65) Prior Publication Data

US 2004/0179866 A1 Sep. 16, 2004

(30) Foreign Application Priority Data

Dec. 18, 2002 (JP) ..... 2002-366619
Jan. 31, 2003 (JP) ..... 2003-024414
May 2, 2003 (JP) ..... 2003-127394

(51) Int. Cl.
*G03G 15/08* (2006.01)

(52) U.S. Cl. ..... 399/258

(58) Field of Classification Search ..... 399/119, 399/120, 224, 258, 259, 260, 261, 262, 263; 222/DIG. 1, 196, 200, 202, 203
See application file for complete search history.

(56) References Cited

U.S. PATENT DOCUMENTS 3,127,065 A 3/1964 Stevenson
4,775,874 A 10/1988 Buyukguclu
4,833,501 A 5/1989 Buyukguclu
5,172,169 A 12/1992 Takashima et al.
5,208,637 A 5/1993 Landa
5,220,383 A 6/1993 Enoki et al.
5,239,344 A 8/1993 Enoki et al.
5,245,391 A 9/1993 Suzuki et al.
5,286,918 A 2/1994 Iwata et al.
5,311,263 A 5/1994 Suzuki et al.
5,386,274 A 1/1995 Sanpe et al.
5,389,733 A 2/1995 Enoki et al.
5,394,231 A 2/1995 Sudo et al.
5,400,127 A 3/1995 Arai et al.
5,426,492 A 6/1995 Diehl
5,435,461 A 7/1995 Smith et al.
5,451,713 A 9/1995 Suzuki et al.
5,467,175 A 11/1995 Takagaki et al.
5,474,869 A 12/1995 Tomita et al.
5,508,794 A 4/1996 Ikesue et al.
5,561,506 A 10/1996 Kasahara (Continued)

FOREIGN PATENT DOCUMENTS

JP 59-100471 6/1984

(Continued)

*Primary Examiner*—Sandra L. Brase
(74) *Attorney, Agent, or Firm*—Oblon, Spivak, McClelland, Maier & Neustadt, P.C.

(57) ABSTRACT

A powder discharging device of the present invention includes a powder container storing powder therein and including a bottom wall formed with an outlet at one end portion for discharging the powder vertically downward. A container moving device moves the powder container toward the above end portion and then generates an acceleration opposite in direction to the movement of the powder container in the powder container to thereby cause the powder to move toward the outlet. The maximum value of the acceleration is between 40 m/sec$^2$ and 200 m/sec$^2$ while a period of time for which the container moving device continuously generates an acceleration of 20 m/sec$^2$ or above is between 3 msec and 30 msec.

25 Claims, 31 Drawing Sheets

U.S. PATENT DOCUMENTS 5,585,598 A 12/1996 Kasahara et al.
5,627,630 A 5/1997 Matsumae et al.
5,663,788 A 9/1997 Sanpe
5,674,408 A 10/1997 Suzuki et al.
5,741,616 A 4/1998 Hirano et al.
5,797,074 A 8/1998 Kasahara et al.
5,819,145 A 10/1998 Tanaka et al.
5,864,733 A 1/1999 Mae et al.
5,875,380 A 2/1999 Iwata et al.
5,953,567 A 9/1999 Muramatsu et al.
5,962,783 A 10/1999 Iwata et al.
5,987,298 A 11/1999 Muramatsu et al.
6,057,515 A * 5/2000 Murai et al. ..... 222/200 X
6,112,046 A 8/2000 Suzuki et al.
6,125,243 A 9/2000 Shoji et al.
6,128,459 A 10/2000 Iwata et al.
6,142,690 A 11/2000 Yoshimura et al.
6,163,669 A 12/2000 Aoki et al.
6,185,401 B1 2/2001 Kanamori et al.
6,198,895 B1 3/2001 Tsuda et al.
6,201,941 B1 3/2001 Kasahara et al.
6,215,974 B1 * 4/2001 Katoh et al. ..... 399/258
6,282,396 B1 8/2001 Iwata et al.
6,292,644 B1 9/2001 Goto et al.
6,295,437 B1 9/2001 Hodoshima et al.
6,335,137 B1 1/2002 Suzuki et al.
6,337,957 B1 1/2002 Tamaki et al.
6,381,435 B1 4/2002 Shinohara et al.
6,393,241 B1 5/2002 Matsumoto et al.
6,403,275 B1 6/2002 Kuramoto et al.
6,442,355 B1 8/2002 Hasegawa et al.
6,442,364 B1 8/2002 Kai et al.
6,458,502 B1 * 10/2002 Nakamura et al. ..... 430/137.17
6,466,749 B1 10/2002 O'Brien
6,468,706 B1 10/2002 Matsuda et al.
6,480,689 B1 11/2002 Jacobs
6,501,913 B1 12/2002 Hattori et al.
6,507,718 B1 1/2003 Ohjimi et al.
6,507,720 B1 1/2003 Kabumoto et al.
6,526,246 B1 2/2003 Iwata et al.
6,542,707 B1 4/2003 Muramatsu et al.
6,567,637 B1 5/2003 Yanagisawa et al.
6,571,076 B1 5/2003 Kasahara et al.
6,597,883 B1 7/2003 Muramatsu et al.
6,608,983 B1 8/2003 Terazawa et al.
6,608,984 B1 8/2003 Matsumoto et al.
6,628,908 B1 9/2003 Matsumoto et al.
6,628,913 B1 9/2003 Matsumoto et al.
6,628,915 B1 9/2003 Muramatsu et al.
6,678,492 B1 1/2004 Terazawa et al.
2001/0052526 A1 * 12/2001 Kasahara et al. ..... 399/258 X
2002/0025195 A1 * 2/2002 Iwata et al. ..... 399/258
2002/0025196 A1 * 2/2002 Matsumoto et al. ..... 399/258
2002/0114646 A1 8/2002 Sudo et al.
2003/0036909 A1 2/2003 Kato
2003/0218642 A1 11/2003 Sakayori et al.

FOREIGN PATENT DOCUMENTS

JP 62-166377 7/1987
JP 62-183481 8/1987
JP 01-133087 5/1989
JP 2-64675 3/1990
JP 2-134554 11/1990
JP 03-011377 1/1991
JP 3-168670 7/1991
JP 4-66984 3/1992
JP 5-9852 1/1993
JP 5-61347 3/1993
JP 5-107911 4/1993
JP 5-265318 10/1993
JP 05-303279 11/1993
JP 6-110304 4/1994
JP 6-242683 9/1994
JP 6-274031 9/1994
JP 7-234575 9/1995
JP 8-240977 9/1996
JP 9-43986 2/1997
JP 09-106156 4/1997
JP 9-244372 9/1997
JP 10-63072 3/1998
JP 10-63075 3/1998
JP 10-69157 3/1998
JP 11-19536 4/1999
JP 11-143194 * 5/1999
JP 11-143195 5/1999
JP 11-272075 10/1999
JP 11-327275 11/1999
JP 2000-81723 3/2000
JP 2000-147879 5/2000
JP 2000-194182 7/2000
JP 2000-203549 7/2000
JP 2001-34008 2/2001
JP 2001-228690 8/2001
JP 2001-315851 11/2001
JP 2002-2833 1/2002
JP 2002-6533 1/2002
JP 2002-46843 2/2002
JP 2002-72645 3/2002
JP 2002-96882 4/2002
JP 2002-99136 4/2002
JP 2002-182461 6/2002
JP 2002-214894 7/2002
JP 2002-268346 9/2002
JP 2003-215903 7/2003
JP 2003-337469 11/2003

* cited by examiner

POWDER DISCHARGING DEVICE AND IMAGE FORMING APPARATUS USING THE SAME

BACKGROUND OF THE INVENTION

1. Field of the Invention

The present invention relates to a powder discharging device including a powder container formed with an outlet for discharging powder and shock applying means for applying a shock to the toner container, and an image forming apparatus using the same.

2. Description of the Background Art

It is a common practice with a copier, facsimile apparatus, printer or similar image forming apparatus to use a toner container storing toner or powder for image formation. For example, in an electrophotographic image forming apparatus configured to form a latent image on an image carrier and then develop it with a developing device, toner is replenished from a toner container to the developing device, as needed. This is also true with a direct recording type of image forming apparatus that causes toner to fly from a toner jetting device toward a sheet or similar recording medium in the form of dots. The toner container is constructed integrally with the developing device or the toner jetting device or implemented as a toner cartridge removably mounted to the apparatus body. When a toner cartridge, for example, mounted to the apparatus body becomes almost empty, it is replaced with a new toner cartridge. At this instant, the toner, if left in the toner cartridge in a large amount, would be wastefully discarded and increase the running cost of the apparatus and would bring about an environmental problem. It is therefore desirable to minimize the amount of toner to be left in the used toner cartridge.

Japanese Patent Laid-Open Publication No. 2002-46843, for example, discloses atoner cartridge configured to discharge toner without wasting it as a toner discharging device. The toner discharging device taught in this document includes a toner cartridge formed with an outlet in its bottom for discharging toner or powder and shock applying means for applying a shock to the toner cartridge. When the shock applying means applies a shock to the toner cartridge, the toner present in the toner cartridge is moved toward the outlet of the toner cartridge and then discharged via the outlet. In this configuration, the toner can be discharged without any waste despite that the toner cartridge lacks a movable member.

However, the toner discharging device with the shock applying means has the following problems left unsolved. When the toner is left unused over a long period of time or used in, e.g., a hot, humid environment, the fluidity of the toner decreases with the result that the amount of the toner to be discharged via the outlet formed in the toner cartridge decreases, resulting in short toner replenishment. To solve this problem, it is necessary to set a relatively large amount of toner discharge beforehand.

The amount of toner discharge may be effectively increased if the shock to act on the toner cartridge is intensified. However, if the shock is excessively intense, then the toner coheres due to compression in the outlet of the toner container and stops it up, i.e., so-called toner blocking occurs. Further, an excessive shock is apt to cause the resulting vibration to be imparted to the apparatus body, adversely effecting an image. If the shock is limited to a degree that does not effect an image, then it is likely that the discharge of the toner cannot follow the consumption of the same when an image with a relatively large area ratio is continuously output.

The toner may be stably discharged from the toner cartridge without regard to the intensity of the shock if the outlet of the toner container is increased in size. This, however, brings about smearing ascribable to the toner in the event of mounting or dismounting of the toner cartridge to or from the apparatus body.

The problems described above are apt to occur even when the toner is replaced with a pigment or similar powder.

On the other hand, Japanese Patent Laid-Open Publication 2002-96882 proposes a powder discharging device constructed to cause a powder container to reciprocate such that an inertia force acts on powder stored in the powder container, thereby discharging the powder. The powder container is formed with an outlet in one end portion of one side wall. Reciprocating means causes the powder container, which is positioned such that the outlet is oriented vertically downward, to reciprocate to thereby move the powder toward the outlet little by little. The powder, reached the outlet, drops via the outlet due to gravity. This configuration makes it needless to arrange a spiral lug, groove or similar special structure or a screw or similar movable member in the powder container and therefore allows the powder to be surely discharged by a simple, low-cost structure.

Further, in the reciprocation type of powder discharging device stated above, an acceleration to act on the powder container when the powder container, moving forward with respect to the direction in which the powder moves toward the outlet, is caused to stop is sized greater than an acceleration to act when it is caused to stop after backward movement, and is so sized as to allow the powder to bodily move toward the outlet. Consequently, an inertia force to act on the powder in the forward direction on the stop of the toner container after forward movement is greater than an inertia force to act on the same in the backward direction on the stop of the toner container after backward movement. The powder can therefore be moved toward the outlet by the reciprocation of the powder container. Moreover, because the acceleration generated by the stop after forward movement is so sized as to allow the powder to bodily move toward the outlet, i.e., 40 m/sec$^2$ or above, the powder can be moved toward the outlet without remaining at the side opposite to the outlet.

Laid-Open Publication No. 2002-96882 stated above describes that by limiting the maximum acceleration to act on the powder container when the powder container is stopped after forward movement to 200 m/sec$^2$, it is possible to replenish the powder by a stable amount without causing it to cohere around the outlet. We, however, experimentally found that when the acceleration at the time when the toner container is stopped after forward movement is simply selected to be 40 m/sec$^2$ or above, the amount of the powder discharged via the outlet is sometimes short. This is also true with, e.g., a powder discharging device configured to suddenly reverse the movement of a powder container moving forward.

Technologies relating to the present invention are also disclosed in, e.g., Japanese Utility Model Laid-Open Publication No. 2-134554 and Japanese Patent Laid-Open Publication Nos. 9-244372, 2000-81723, 2001-34008, 2002-6533, 2002-72645, 2002-99136, 2002-182461 and 2002-268346.

SUMMARY OF THE INVENTION

It is a first object of the present invention to provide a powder discharging device capable of allowing powder stored in a powder container to surely move toward an outlet without remaining at the side opposite to the outlet, and an image forming apparatus using the same.

It is a second object of the present invention to provide a powder discharging device capable of discharging powder from a powder container even when a shock to be applied to the powder container by shock applying means is of a degree not adversely effecting an image, and an image forming apparatus using the same.

It is a third object of the present invention to provide a powder discharging device capable of desirably discharging powder from a powder container without stopping up the powder container without regard to the degree of the shock or the size of the outlet formed in the powder container, and an image forming apparatus using the same.

A powder discharging device of the present invention includes a powder container storing powder therein and including a bottom wall formed with an outlet at one end portion for discharging the powder vertically downward. A container moving device moves the powder container toward the above end portion and then generates an acceleration opposite in direction to the movement of the powder container in the powder container to thereby cause the powder to move toward the outlet. The maximum value of the acceleration is between 40 m/sec$^2$ and 200 m/sec$^2$ while a period of time for which the container moving device continuously generates an acceleration of 20 m/sec$^2$ or above is between 3 msec and 30 msec.

An image forming apparatus using the above powder discharging device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
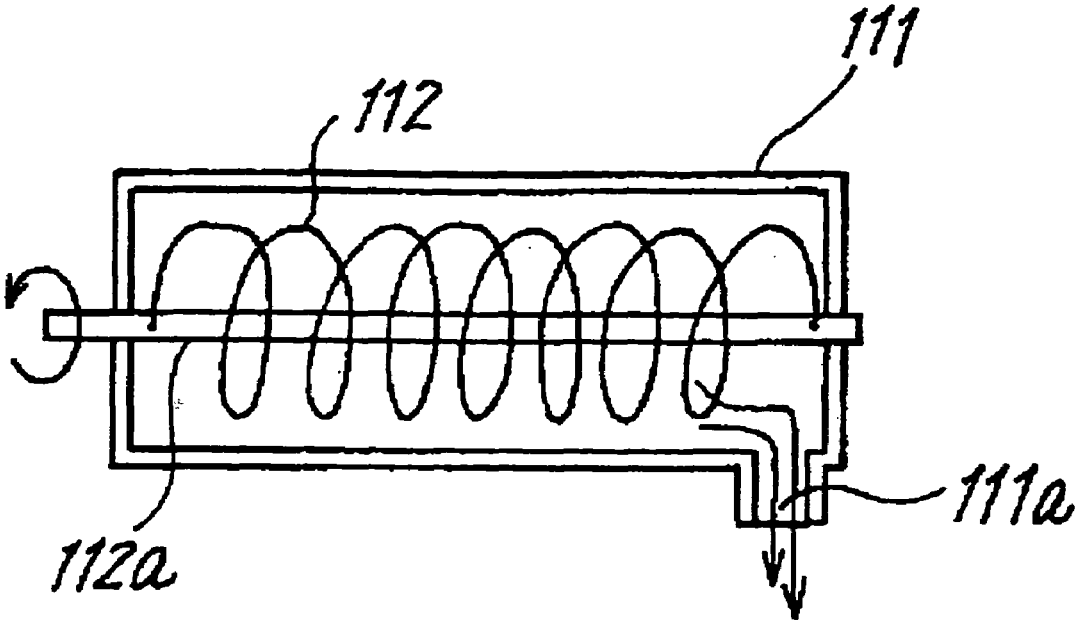
FIG. 1 PRIOR ART
FIG. 1 is a view showing a conventional toner container.

To better understand the present invention, brief reference will be made to a conventional toner discharging device, shown in FIG. 1. As shown, the toner discharging device is implemented as a toner cartridge made up of a toner container 111 and a screw, coil spring or similar movable member 112 disposed in the toner container 111. When a shaft 112*a*, included in the movable member 112, is rotated, the movable member 112 conveys toner stored in the toner container 111 toward an outlet 111*a* with the result that the toner is replenished to a hopper, not shown, via the outlet 111*a*. The movable member 112, however, increases the replacement cost of the toner container 111. Further, the toner container 111 is formed with an opening to allow the movable member 112 to be rotated by an external drive source, so that the opening must be sealed by a seal member, making the structure of the toner container 111 sophisticated.

Figure 2:
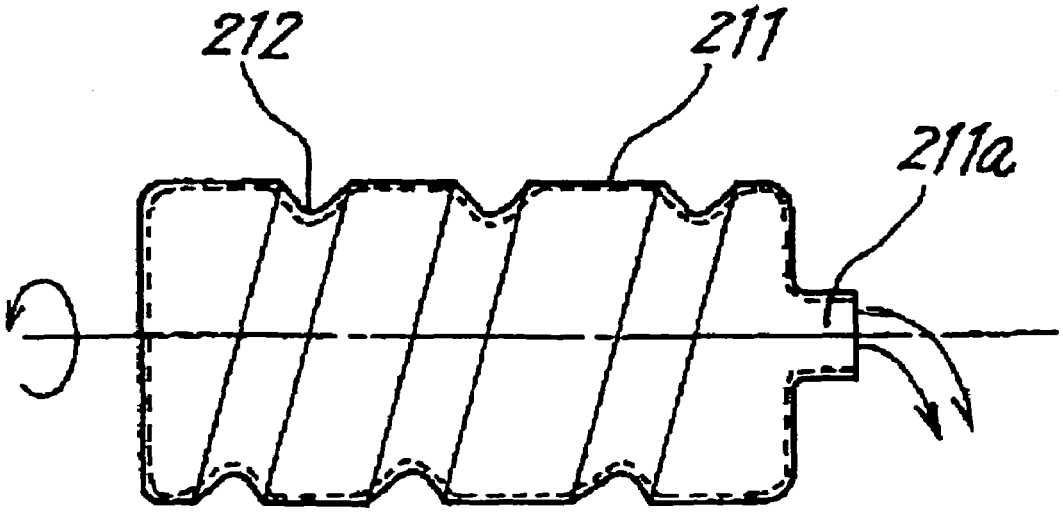
FIG. 2 PRIOR ART
FIG. 2 is a view showing another conventional toner container.

FIG. 2 shows another conventional toner discharging device. As shown, the toner discharging device comprises a hollow, cylindrical toner container 211 generally referred to as a screw bottle and formed with a spiral ridge 212, which protrudes to the inside of the toner container. When the screw bottle 211 is rotated, the spiral ridge 212 conveys toner stored in the screw bottle 211 toward an outlet 211*a*. A problem with the screw bottle 211 is that the spiral ridge 212 also makes the structure of the screw bottle 211 sophisticated. Further, the screw bottle 211, which is cylindrical, cannot hold a large amount of toner, compared to a rectangular toner container. In addition, the screw bottle 211 is not easy to handle because the operator's hand, holding the screw bottle 211, is apt to slip.

Preferred embodiments of the present invention will be described hereinafter.

First Embodiment

Figure 3:
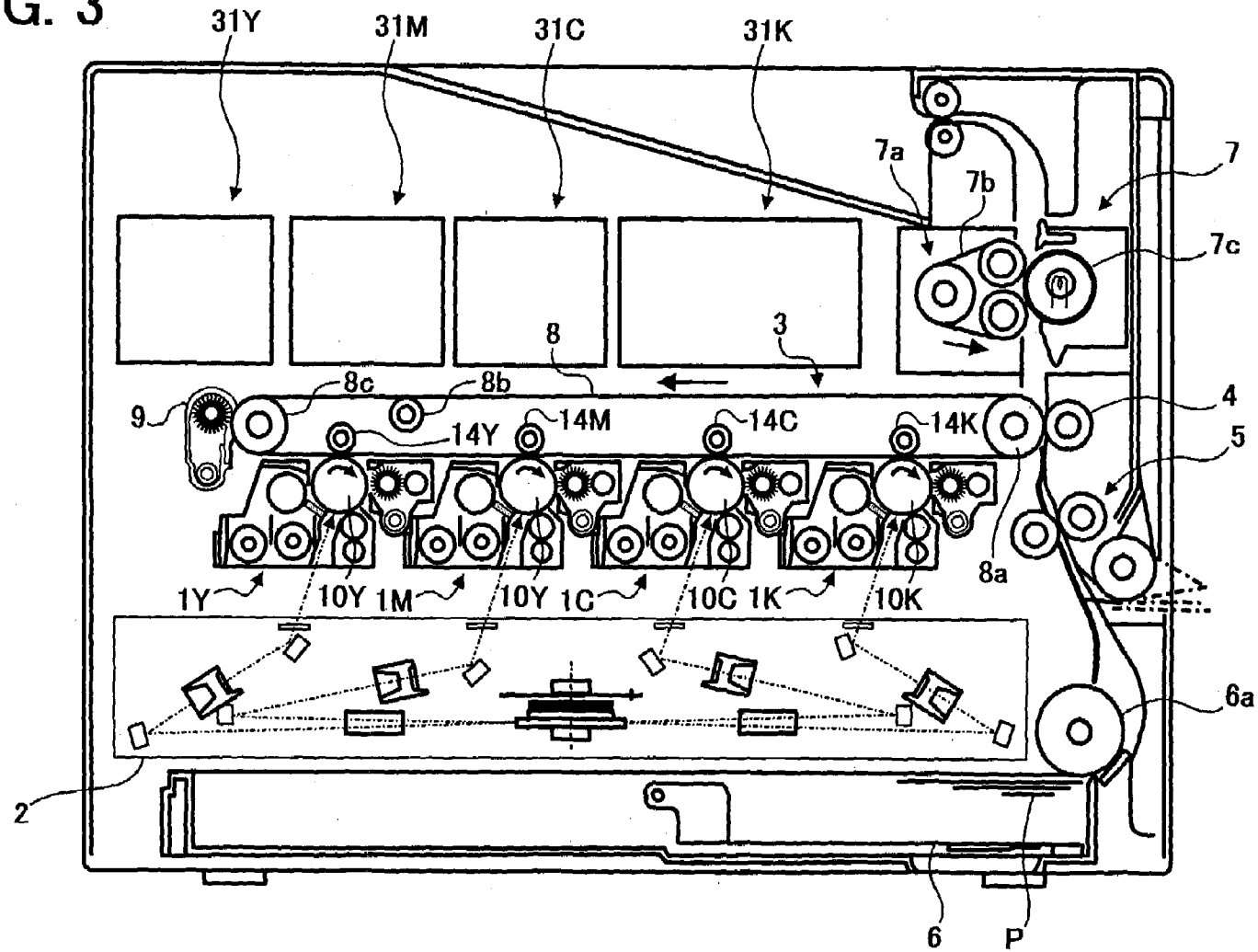
FIG. 3 is a view showing a first embodiment of the image forming apparatus in accordance with the present invention.

A first embodiment is directed toward the first object stated earlier and applied to a tandem, color laser beam printer by way of example. As shown in FIG. 3, the printer includes four process units 1Y (yellow), 1M (magenta), 1C (cyan) and 1K (black) configured to form a yellow, a magenta, a cyan and a black toner image, respectively. The printer further includes an optical writing unit 2, an intermediate image transferring unit 3, a bias roller 4 for secondary image transfer, a registration roller pair 5, a sheet cassette 6, and a fixing unit 7 using a belt.

Figure 4:
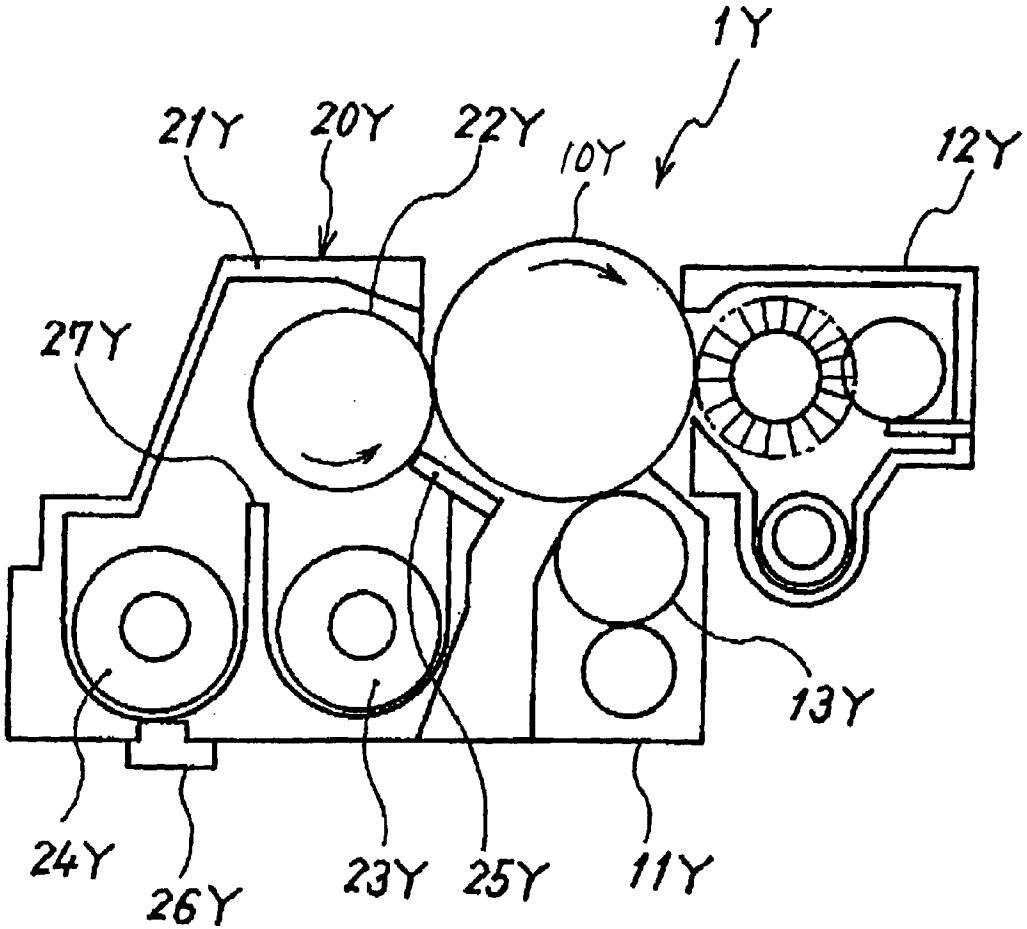
FIG. 4 is an enlarged view showing a yellow process unit included in the illustrative embodiment by way of example.

FIG. 4 shows the yellow process unit 1Y by way of example. The other process units 1M, 1C and 1K are identical in configuration with the process unit 1Y and will not be described specifically in order to avoid redundancy. As shown, the process unit 1Y includes a photoconductive drum or image carrier 10Y, a charger 11Y, a drum cleaner 12Y, and a quenching lamp not shown.

The charger 11Y includes a charge roller 13Y to which an AC voltage is applied. The charge roller 13Y is held in contact with the drum 10Y for thereby uniformly charging the surface of the drum 10Y. The optical writing unit 2 scans the charged surface of the drum 10Y with a laser beam in accordance with image data, thereby forming a latent image on the drum 10Y. A developing device 20Y develops the latent image thus formed on the drum 10Y with Y toner to thereby produce a Y toner image. For the charger 11Y, use may be made of a charge roller or a charge brush by way of example.

The developing device 20Y includes a casing 21Y and a sleeve 22Y disposed in the casing 21Y while being partly exposed to the outside via an opening formed in the casing 21Y. A first and a second screw 23Y and 24Y, respectively, a doctor 25Y and a toner content sensor 26Y are also included in the developing device 20Y. A partition 27Y, intervening between the first and second screws 23Y and 24Y, divides the casing 21Y into a first and a second developer chamber accommodating the screws 23Y and 24Y, respectively.

A two-component type developer, made up of magnetic carrier grains and Y toner grains chargeable to negative polarity, is stored in the casing 21Y. The developer is conveyed by the screws 23Y and 24Y while being frictionally charged by agitation and is then deposited on the sleeve 22Y. The developer thus deposited on the sleeve 22Y is conveyed to a developing zone where the sleeve 22Y faces the drum 10Y after being metered by the doctor 25Y. In the developing zone, the Y toner of the developer deposits on the latent image formed on the drum 10Y. Subsequently, the developer is returned to the casing 21Y by the rotation of the sleeve 22Y.

The toner content sensor 26Y, implemented by a permeability sensor, is mounted on the bottom of the casing 21Y at the center portion of the second developer chamber in the direction of developer conveyance so as to output a voltage corresponding to the permeability of the developer, which moves above the sensor 26Y. More specifically, the permeability of the developer is related to the toner content of the developer to a certain extent, so that the output voltage of the toner content sensor 26Y corresponds to the toner content. The output voltage of the sensor 26Y is sent to a controller not shown. The controller includes a RAM (Random Access Memory) storing a target value Vtref for Y to which the sensor output should be controlled. It is to be noted that the RAM stores target values Vtref for M, C and K as well. The target value Vtref is used to control the drive of a Y toner conveying device not shown.

As shown in FIG. 3, four toner containers or toner cartridges 31Y, 31M, 31C and 31K, respectively storing Y toner, M toner, C toner and K toner, are positioned at one side of the fixing unit 7. The toner container 31Y is mounted to a Y toner replenishing device, not shown, so as to feed the Y toner to the developing device 20Y. The controller controls the Y toner replenishing device such that the output voltage of the toner content sensor 26Y approaches the target value Vtref for Y, thereby confining the Y toner content in the developing device 20Y in a preselected range. This is also true with the other process units.

The Y toner image formed on the drum 10Y is transferred to an intermediate image transfer belt, which will be described later specifically. After the image transfer, the drum cleaner 12Y removes the toner left on the drum 10Y, and then the quenching lamp discharges the surface of the drum 10Y to thereby prepare it for the next image formation. This is also true with the other process units.

As shown in FIG. 3, the intermediate image transferring unit 3 includes an intermediate image transfer belt (simply belt hereinafter) 8, a drive roller 8*a*, support rollers 8*b* and 8*c*, a belt cleaner 9, and four bias rollers 14Y, 14M, 14C and 14K for primary image transfer. The belt 8, passed over the drive roller 8*a* and support rollers 8*b* and 8*c*, is caused to turn counterclockwise, as viewed in FIG. 3, by the drive roller 8*a*, which is, in turn, driven by a driveline not shown. The bias rollers 14Y through 14K each are applied with a bias for image transfer from a power supply not shown. The bias rollers 14Y through 14K press the belt 8 against the drums 10Y through 10K, respectively, forming nips for primary image transfer. At each nip, an electric field is formed between the drum and the bias roller due to the influence of the bias. The Y toner image on the drum 10Y is transferred to the belt 8 by the electric field and nip pressure (primary image transfer). Subsequently, the M, C and K toner images are sequentially transferred from the drums 10M, 10C and 10K, respectively, to the belt 8 over the Y toner image, completing a four- or full-color toner image on the belt 8. The full-color toner image is then transferred to a sheet P at a secondary image transfer nip, which will be described later, (secondary image transfer). The toner left on the belt 8 after the secondary image transfer is removed by the belt cleaner 9, which contacts part of the belt 8 backed up by the support roller 8*c*.

The bias roller 4 for secondary image transfer is pressed against the drive roller 8*a* via the belt 8, forming a secondary image transfer nip. A power supply, not shown, applies a bias to the bias roller 4. The sheet cassette 6 is positioned below the optical writing unit 2 and loaded with a stack of sheets P. A pickup roller 6*a*, resting on the top sheet P, is rotated to pay out the top sheet P to a sheet path. The sheet P thus paid out is conveyed to the registration roller pair 5 via the sheet path and nipped by the roller pair 5.

On the other hand, the full-color toner image carried on the belt 8 is brought to the secondary image transfer nip by the belt 8. The registration roller pair 5 starts conveying the sheet P toward the secondary image transfer nip such that the leading edge of the sheet P meets the leading edge of the full-color toner image at the above nip. As a result, the toner image is transferred from the belt 8 to the sheet P, which is white, by the bias and nip pressure. The sheet P, thus carrying the toner image thereon, is conveyed to the fixing unit 7.

The fixing unit 7 includes a belt unit 7*a* in which a fixing belt 7*b* is supported by three rollers, and a heat roller 7*c* accommodating a heat source therein. The belt unit 7*a* and heat roller 7*c* fix the toner image on the sheet P while conveying the sheet P in cooperation. The sheet P, coming out of the fixing unit 7, is driven out of the printer via an outlet roller pair.

Figure 5:
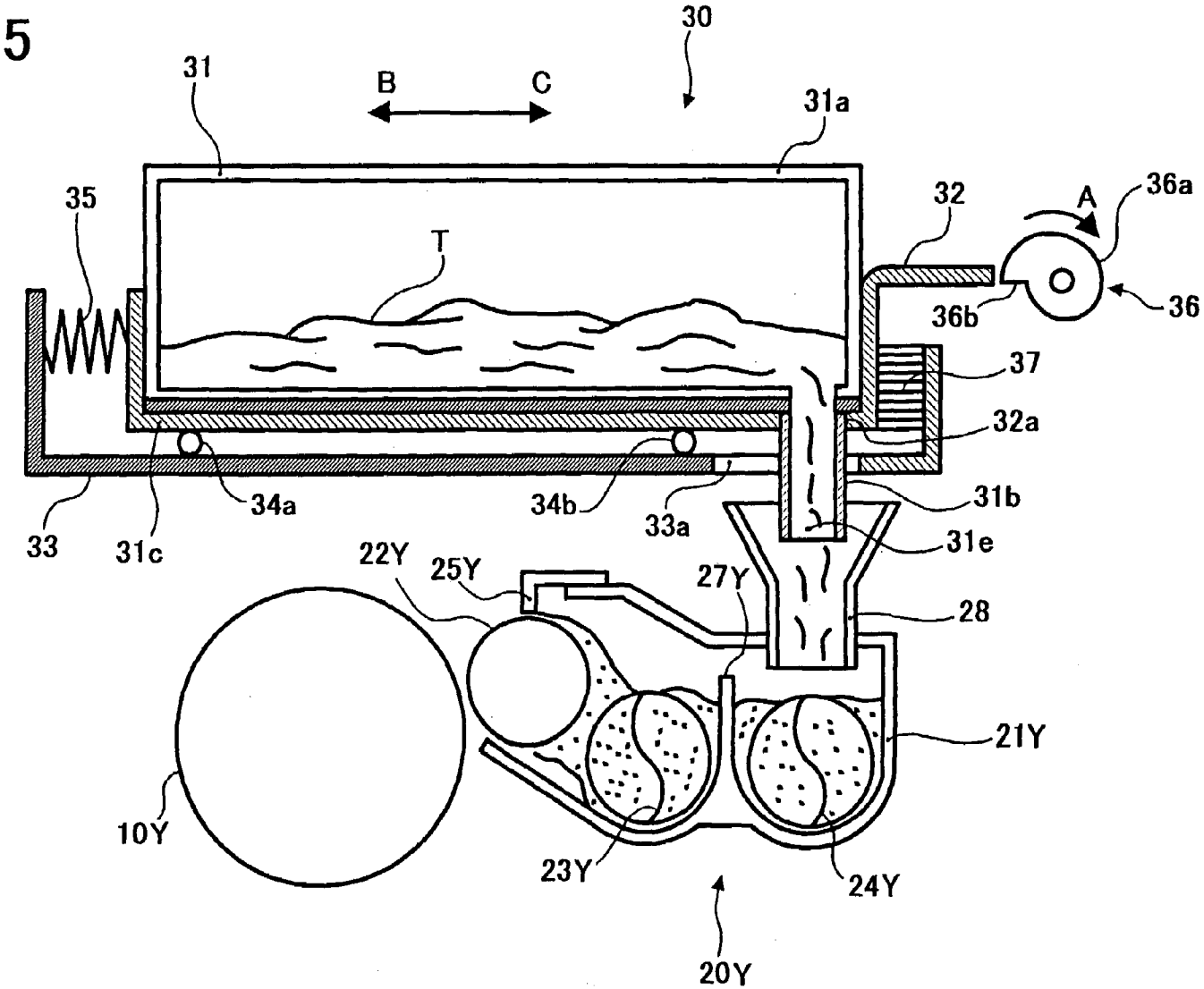
FIG. 5 is a view showing a toner discharging device included in the illustrative embodiment.

Reference will be made to FIG. 5 for describing a toner discharging device 30 characterizing the illustrative embodiment. While one toner discharging device is assigned to each developing device, the following description will concentrate on a toner discharging device assigned to the yellow developing device 20Y byway of example. In the following description, the suffixes Y, M, C and K will be omitted.

As shown in FIG. 5, the toner discharging device 30 includes a holder 32 and a support base 33 in addition to the toner container 31. The support base 32 is affixed to the side walls, not shown, of the developing device in a substantially horizontal position. The holder 32 is removably mounted to the support base 33. The toner container 31 is removably mounted to the holder 32 and support base 33.

In the illustrative embodiment, the toner container 31 is implemented as a flexible bag formed of polyethylene, nylon or similar resin or paper in a single-layer or a laminate structure. In the illustrative embodiment, at least the inner walls of the toner container 31 are formed of polyethylene.

More specifically, the toner container 31 is made up of a flexible bag 31*a*, a mouth member 31*b* formed of resin or similar material harder than the bag 31*a*, and a rigid member 31*c* formed of a resin or similar material also harder than the bag 31*a*. The rigid member 31*c* is adhered to the surface of the bag 31*a* that faces vertically downward when the toner container 31 is mounted to the toner discharging device 30. The mouth member 31*b* is formed integrally with the rigid member 31*c* and has a through bore communicated to the inside of the bag 31*a*, forming an outlet 33*a* of the toner container 31. If desired, the bag 31*a*, mouth member 31*b* and rigid member 31*c* maybe formed of the same material, so that the toner container 31 can be recycled without needing classification.

Figure 6:
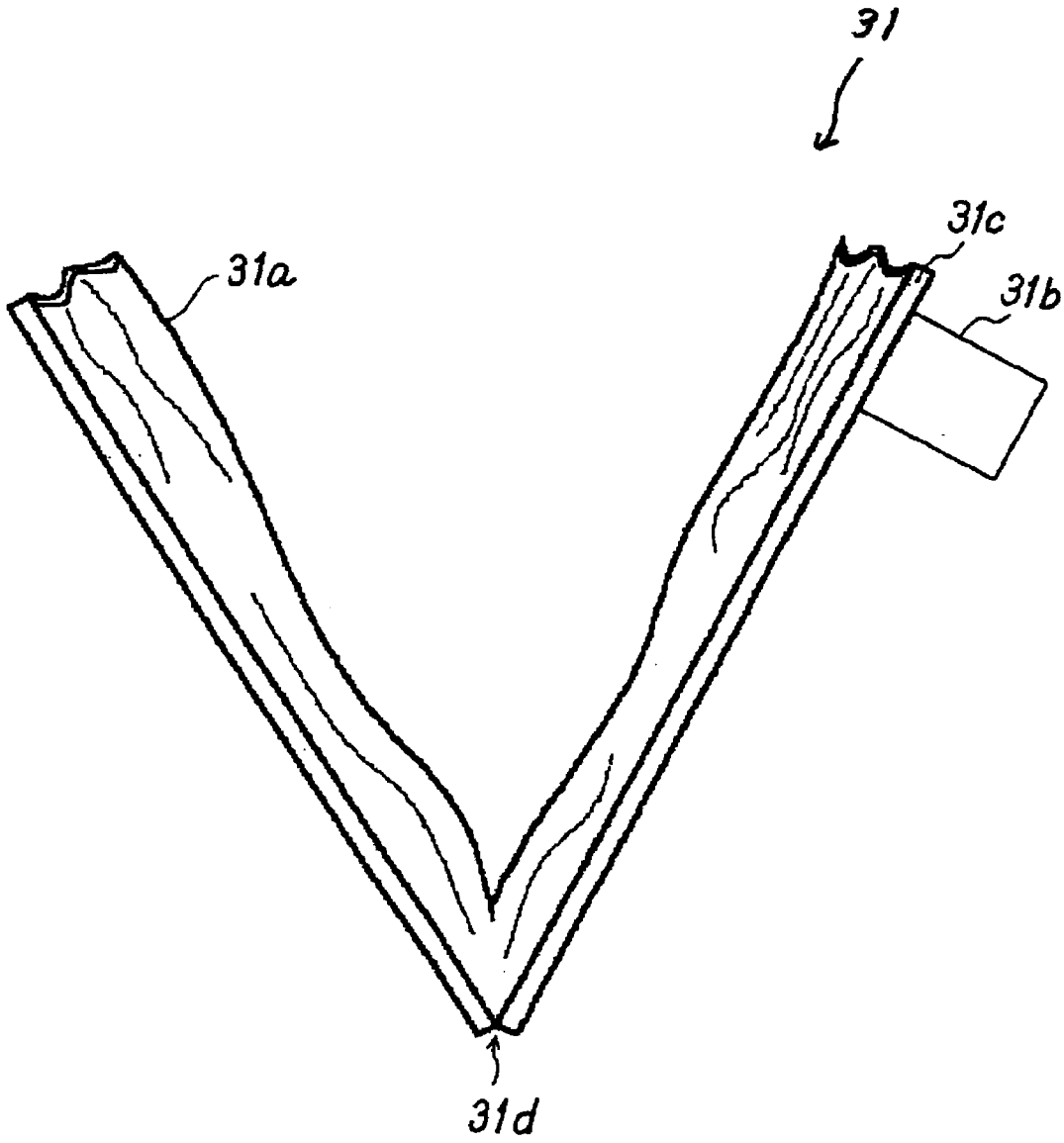
FIG. 6 demonstrates how a toner container included in the toner discharging device is folded down when run out of toner.

FIG. 6 shows how the toner container 31 is collected when run out of toner. The toner container 31, run out of toner, must be collected by the manufacturer from the user's station for recycling. As shown in FIG. 6, in the illustrative embodiment, the toner container 31 is flexible and can therefore be folded down. In this condition, the toner container 31 can be easily handled in the event of transport or needs a minimum of spaced when stored, successfully reducing delivery cost. Particularly, the rigid member 31*c* is formed with a fold 31*d* at the center in the lengthwise direction and can therefore folded down in two along the fold, as illustrated.

If desired, an air filter, not shown, may be mounted on the toner container 31, so that the bag 31*a* decreases in size in accordance with the consumption of the toner.

Figure 7A:
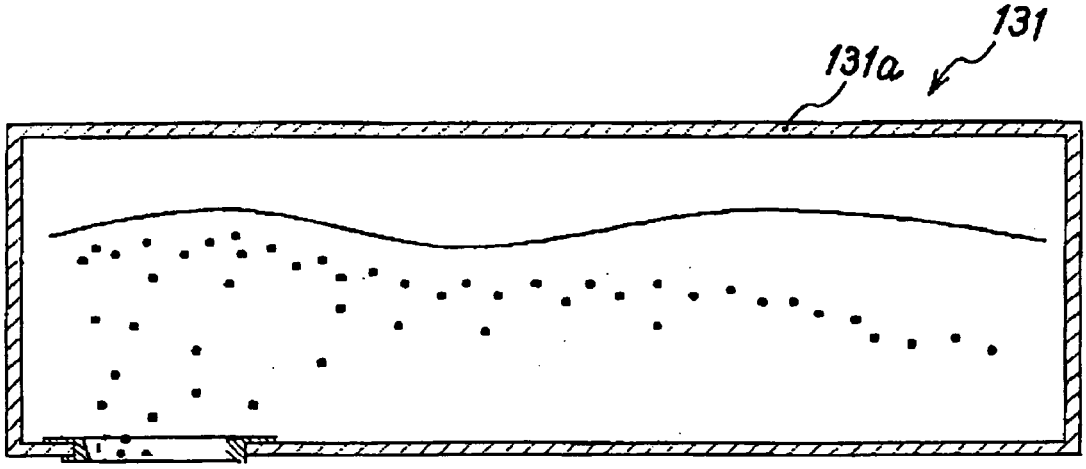
FIGS. 7A and 7B are views each showing another specific configuration of the toner container.

While the toner container 31 of the illustrative embodiment includes a flexible portion, it may be entirely formed of a rigid member, if desired. For example, FIG. 7A shows a toner container 131 implemented by a box 131*a* having thickness of 0.5 μm to 2 μm and formed of resin or similar hard material. Although such a hard toner container 131 occupies a substantial space when run out of toner, it can be easily mounted to the toner discharging device 30.

Figure 7B:
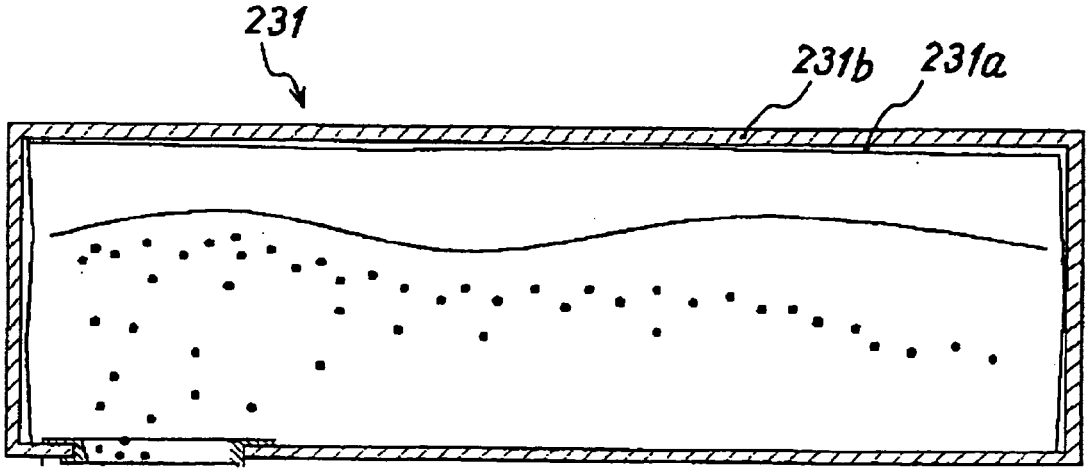

FIG. 7B shows another toner container 231 made up of a rigid box 231*b* and a flexible bag 231*a*, which is similar to the bag 31*a*, accommodated in the box 231*b*. When the toner container 231 runs out of toner, only the bag 231*a* can be replaced and collected. This not only promotes easy handling in the event of collection and reduces space, but also allows the toner container 231 to be easily mounted to the toner discharging device 30.

To mount the toner container 31 to the toner discharging device 30, the holder 32, removed from the device 30 beforehand, and the toner container 31 are joined together. More specifically, as shown in FIG. 5, the mouth member 31*b* of the toner container 31 is inserted into an opening 32*a* formed in the holder 32. The mouth portion 31*b* is then inserted into the opening 33*a* formed in the support base 33, so that the toner container 31 is set on the toner discharging device 30 via rollers 34*a* and 34*b*. In this condition, the outlet 31*e* of the toner container 31 faces a toner hopper 28 positioned beneath the outlet 31*e*.

The opening 32*a* of the holder 32 is so configured as to restrict the movement of the outlet 31*e* in the opening 32*a*. On the other hand, the opening 33*a* of the support base 33 is so configured as to allow the outlet 31*e* to move in the opening 33*a* on the support base 33 together with the holder 32 in directions B and C, as indicated by a double-headed arrow.

Figure 8:
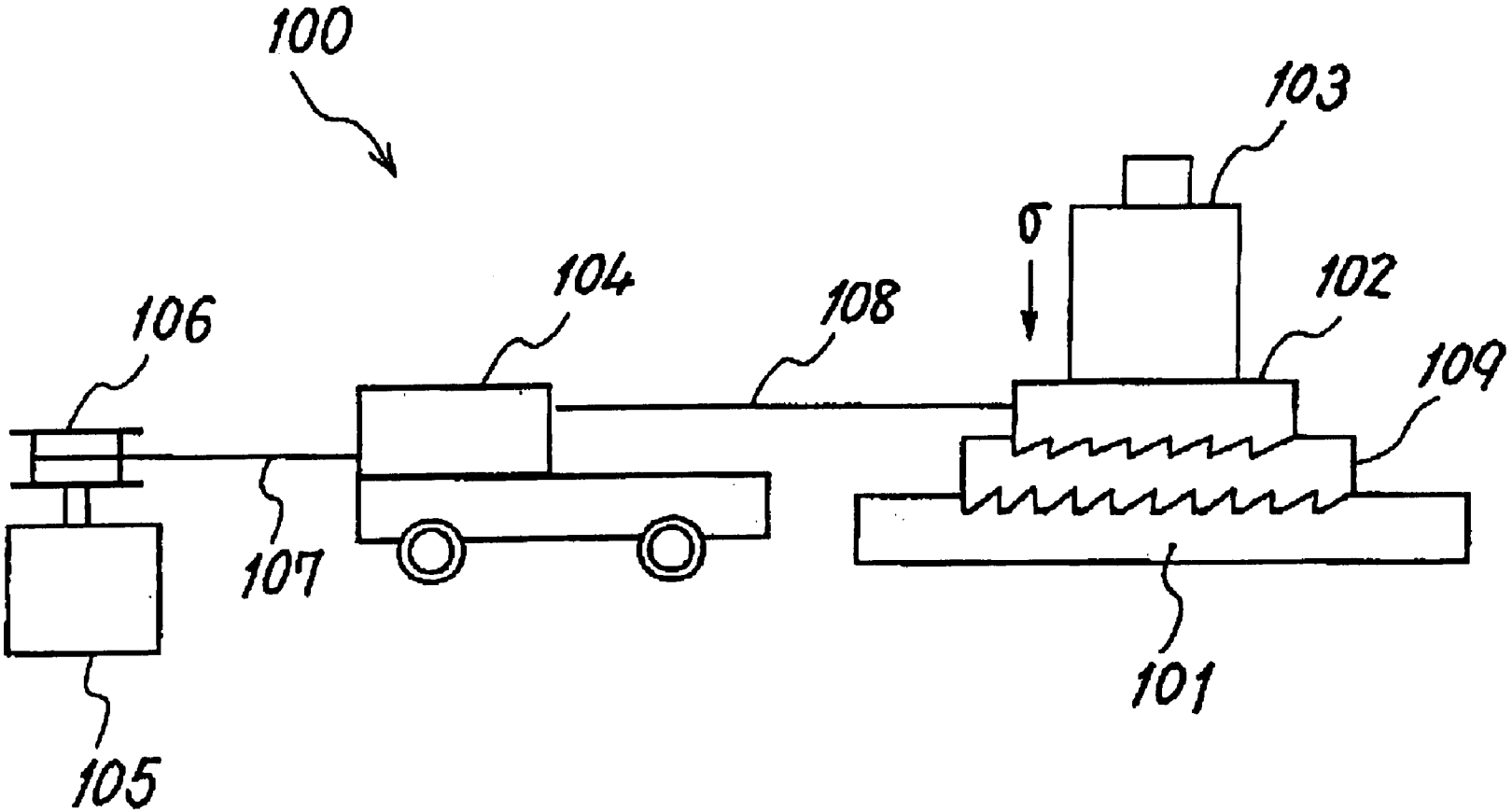
FIG. 8 shows a specific shear tester used to measure the maximum shear stress and uniaxial breakdown stress of toner.

Hereinafter will be described toner applicable to the illustrative embodiment. FIG. 8 shows a shear tester 100 used to measure the maximum shear stress or the uniaxial breakdown stress of toner. The shear tester 100 has customarily been used to measured the maximum shear stress or the uniaxial breakdown stress, which is the index of fluidity of powder. As shown, the shear tester 100 includes a stationary plate 101 having a regularly saw-toothed top, a movable plate 102 having a regularly saw-toothed bottom, a weight 103, and a load cell 104 movable with four wheels. The shear tester 100 additionally includes a drive motor 105 for driving the load cell 104, a reel 106 affixed to the output shaft of the drive motor 105, a wire 107 wound round the reel 106, and a wire connecting the load cell 104 and movable plate 102.

Toner or sample 109 is placed on the saw-toothed top of the stationary plate 101, and then the movable plate 102 is positioned on the toner 109 with its saw-toothed bottom facing downward. Preselected vertical stress acts on the toner 109 due to the weight of the weight 103 and that of the movable plate 101. The wire 108 is connected to the movable plate 102 at one end and connected to the load cell as the other end. The wire 107 is connected to the load cell 104.

When the drive motor 105 is rotated, the reel 106 takes up the wire 107 with the result that the load cell 104 with the wheels move toward the reel 106. At the same time, the movable plate 102 moves in the same direction as the load cell 104 by being pulled by the load cell 104 via the wire 108, exerting shear stress on the toner 109.

The uniaxial breakdown stress of the toner was measured by the shear tester 100 by the following method. A toner layer sized about 50 mm×70 mm×6 mm was placed on the stationary plate 101 and then preliminary pressed by about 70 g/cm$^2$ derived from the weight of the movable plate 102 and weight 103. The weight 103 was then replaced with a lighter weight for exerting vertical stress $\sigma$ of 20 g/cm$^2$ or below on the toner layer.

Figure 9:
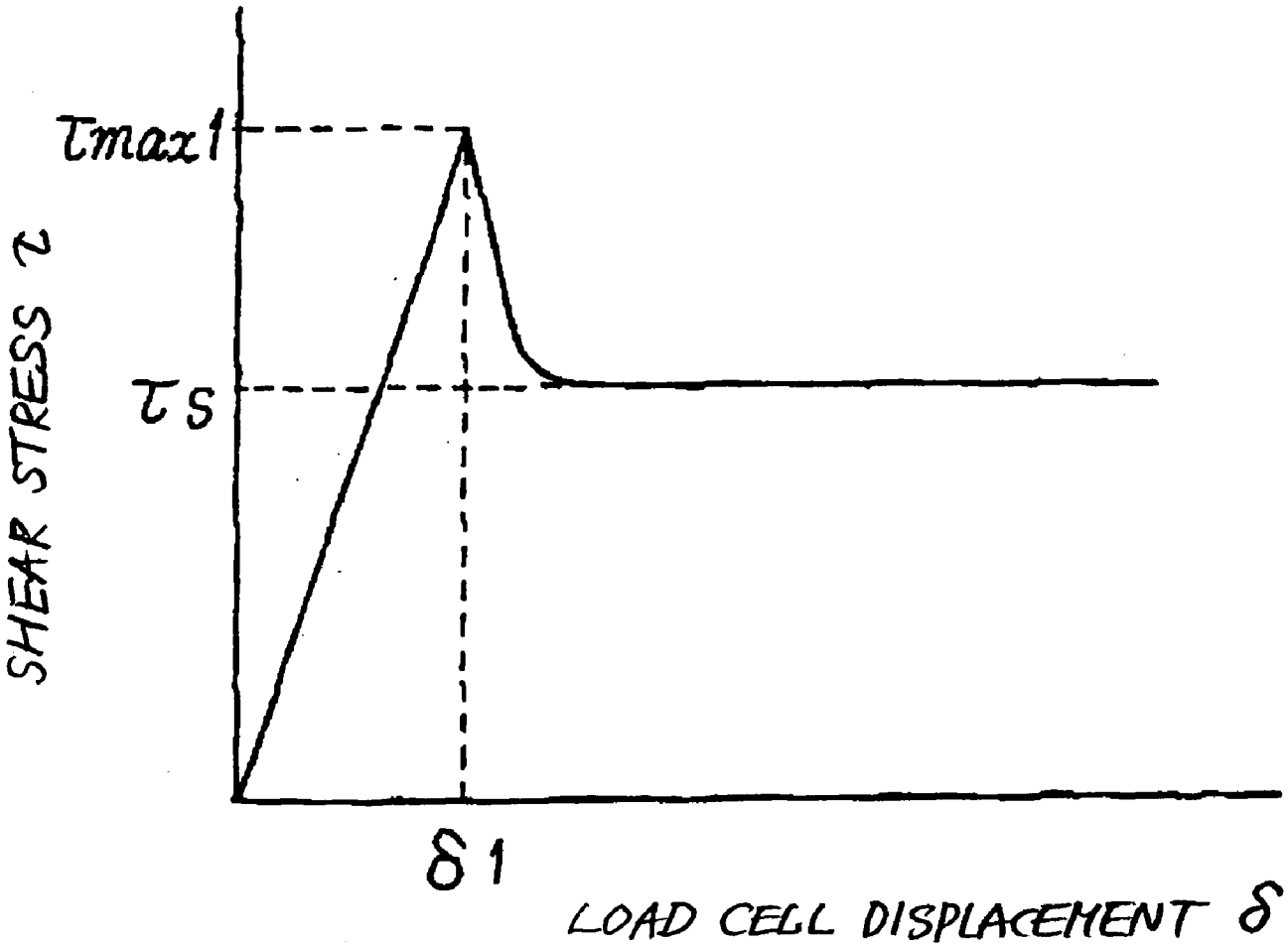
FIG. 9 is a graph showing a relation between the displacement of a load cell included in the shear tester and a shear stress acting on a powder layer.

Subsequently, the load cell 104 was moved little by little in the horizontal direction with the above vertical stress a being exerted on the toner layer, thereby exerting shear stress on the toner layer. FIG. 9 shows a relation between the displacement $\delta$ of the load cell 104 and the shear stress $\tau$ acting on the toner layer. As shown, the shear stress $\tau$ increases with an increase in the displacement $\delta$ of the load cell 104. When the displacement $\delta$ reaches 1, the toner layer breaks down, i.e., the shear stress reaches the maximum value $\tau$max1, as measured when the vertical stress is $\sigma$1. Thereafter, the shear stress $\tau$ remains at a preselected value $\tau$s.

To measure the uniaxial breakdown stress, the maximum shear stress $\tau$max is measured with two or more different vertical stresses $\sigma$, and then an approximate linear equation representative of a relation between the vertical stress $\sigma$ and the shear stress $\tau$max is determined on the basis of the results of measurement. Subsequently, the diameter of a circle that contacts the origin or zero point of resulting approximate line in the $\sigma$-$\tau$ coordinates and the approximate line is determined as a uniaxial breakdown stress fc.

Figure 10:
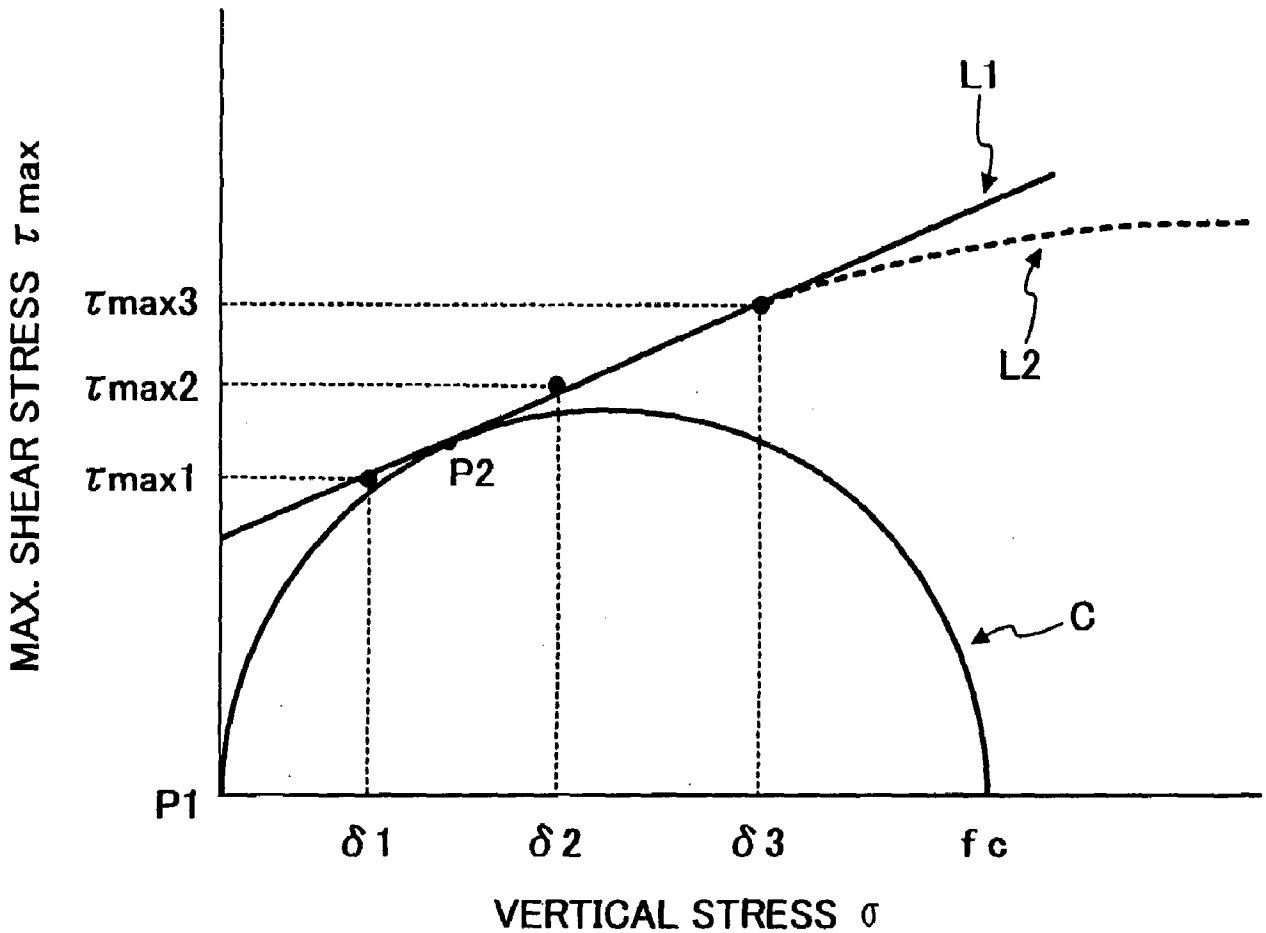
FIG. 10 is a graph showing a relation between a vertical stress acting on toner set on the shear tester and the maximum shear stress.

FIG. 10 shows a specific relation between the vertical stress $\sigma$ and the maximum shear stress $\tau$max. As shown, maximum shear stresses $\tau$max1, $\tau$max2 and $\tau$max3 are determined with three different vertical stresses 94 1, $\sigma$2 and $\sigma$3, respectively, to thereby obtain an approximate line L1. In a strict sense, when the maximum shear stress measured with four or more vertical stresses $\sigma$, the relation between the vertical stress $\sigma$ and the maximum shear stress $\tau$max is represented by a breakdown envelope curve L2. However, for the measurement of uniaxial breakdown stress, use is made of the approximate line L1 instead of the envelope curve L2. Subsequently, the diameter of a circle C, contacting the origin P1 of the approximate line L1 in the $\sigma$-$\tau$ coordinates and the point P2 of the approximate line L1 is determined as a uniaxial breakdown stress fc.

As FIG. 10 indicates, for vertical stresses $\sigma$ around the point P2 where the circle C and approximate line L1 contact, substantially the same uniaxial breakdown stress fc is obtained with both of the approximate line L1 and breakdown envelope line L2.

While the uniaxial breakdown stress fc thus obtained has customarily been used as a characteristic value representative of the fluidity of toner, we found that it has great influence on the amount of toner to be discharged by the illustrative embodiment, as will be described hereinafter.

Figure 11:
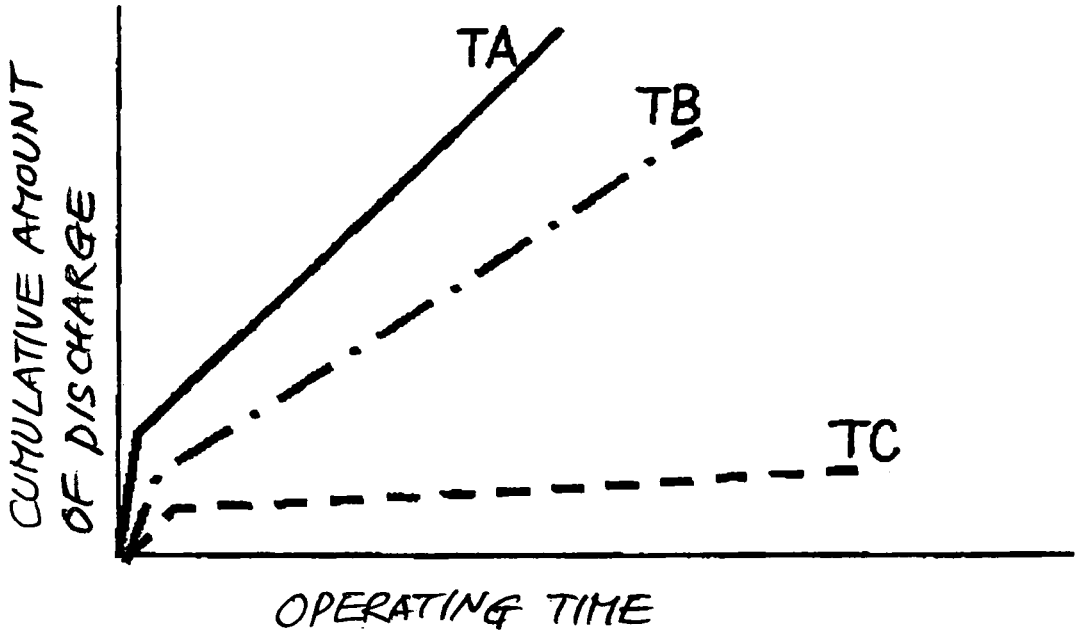
FIG. 11 is a graph showing a relation between the duration of operation of the toner discharging device and the cumulative amount of toner discharged with respect to three kinds of toner each having a particular uniaxial breakdown stress.

FIG. 11 shows a relation between the operating time of the toner discharging device of the illustrative embodiment and the cumulative amount of toner discharged with respect to three kinds of toners TA, TB and TC each having a particular uniaxial breakdown stress fc. The toners TA, TB and TC had stresses fc of 6 g/cm$^2$, 15 g/cm$^2$ and 24 g/cm$^2$, respectively. A series of researches and experiments showed that the amount of toner discharged tended to increase with a decrease in stress fc. More specifically, as FIG. 11 indicates, the amount of toner discharged is desirable when the stress fc is 15 g/cm$^2$ or below, but is short if it is larger than 15 g/cm$^2$. In light of this, the illustrative embodiment uses the toner with the stress fc of 15 g/cm$^2$.

Referring again to FIG. 5, the illustrative embodiment further includes reciprocating means or container moving means for moving toner T present in the toner container 31 toward the outlet 31*e*. As shown, a spring or biasing means 35 affixed to the support base 33 for biasing the holder 32 and toner container 31 in the direction C. A rotatable cam 36 includes a cam surface contacting the end of the holder 32 opposite to the end that the spring 35 contacts. A damper 37 is formed of elastic rubber and affixed to the end of the support base 33 opposite to the end to which the spring 35 is affixed. The spring 35, cam 36 and damper 37 constitute the reciprocating means in combination.

Figure 12:
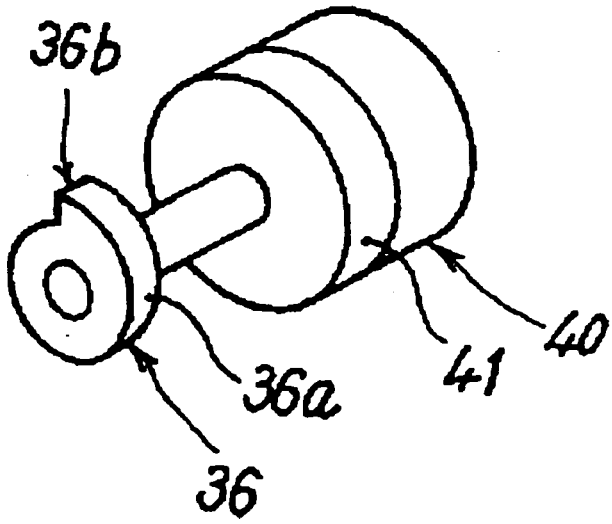
FIG. 12 is an isometric view showing a cam, a motor and a speed reducer included in the illustrative embodiment.

As shown in FIG. 12, the cam 36 is mounted on the output shaft of a motor 40 affixed to the support base 33 and a speed reducer 41 and is rotated at a speed adequately determined by the motor 40 and speed reducer 41. The cam 36 includes an eccentric cam 36*a* and a stepped portion 36*b*. When the cam 36 is rotated in a direction indicated by an arrow in FIG. 5 with the eccentric cam 36*a* contacting the holder 32, the cam 36 presses the end of the holder 32 against the bias of the spring 35, thereby moving the holder 32 and toner container 31 in the direction B, FIG. 5.

When the stepped portion 36*b* of the cam 36 contacts the holder 32 in accordance with the rotation of the cam 36, the pressure of the cam 36, acting on the holder 32 is canceled. As a result, the holder 32 and toner container 31 move in the direction C, FIG. 5, due to the bias of the spring 5 until the damper 37 and support base 33, serving as sudden stop means, stop them.

Figure 13:
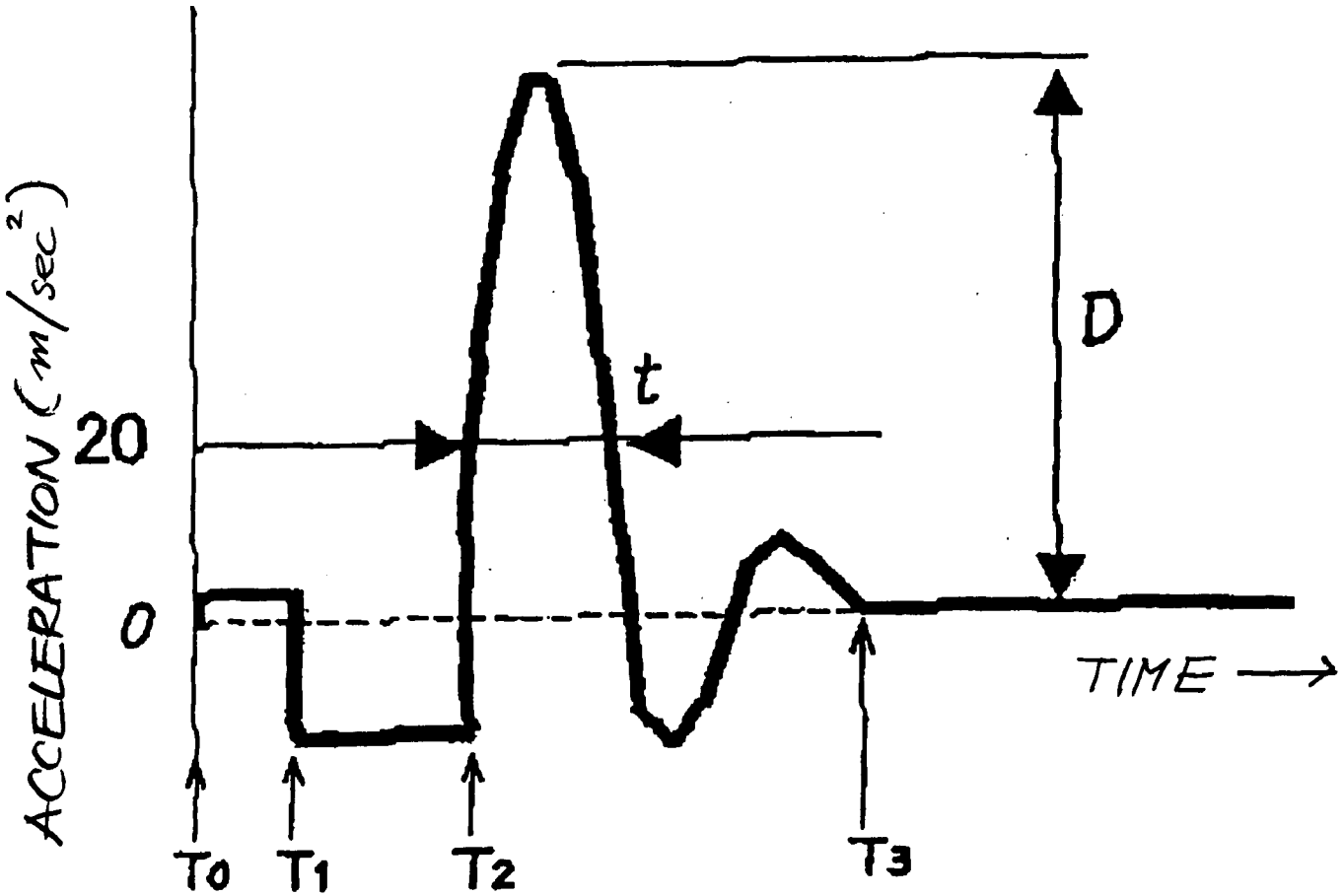
FIG. 13 is a graph showing how acceleration, acting on the toner container, varies during one reciprocation of the toner container.

FIG. 13 shows how acceleration, acting on the toner container 31, varies during a single reciprocation with respect to time. In FIG. 13, acceleration has positive values when acting in the direction B, FIG. 5, or negative values when acting in the direction C, FIG. 5. As shown, when the cam 36 is rotated in a direction indicated by an arrow A in FIG. 5, the eccentric cam 36*a* of the cam 36 contacts the end of the holder 32 at a time $T_0$, starting pressing the holder 32 against the bias of the spring 35. The holder 32 and toner container 31 therefore start moving forward, i.e., in the direction B with a small acceleration. When the cam 36 is further rotated in the direction A, the stepped portion 36*b* of the cam 36 contacts the holder 32 at a time $T_1$. At this time, the pressure of the eccentric cam 36*a*, acting on the holder 32, is canceled with the result that the holder 32 and toner container 31 move backward, i.e., in the direction C with increasing acceleration due to the bias of the spring 35.

At a time $T_2$, the holder 32 and toner container 31, moving in the direction C, hits against the damper 37 affixed to the support base 33. At this instant, a great acceleration in the direction B occurs in the holder 32 and toner container 31 having moved in the direction C. As a result, the toner Tin the toner container 31 is subject to an inertia force acting in the direction C and therefore moves in the direction C toward the outlet 31*e*. Subsequently, the holder 32 and toner container 31 stop moving at a time $T_3$ after residual vibration.

The reciprocation stated above is repeated to cause the toner T in the toner container 31 to move toward the outlet 31*e* little by little. Consequently, the toner T drops via the outlet 31*e* due to its own weight and is then replenished to the developing device 2.

The reciprocation occurs along a virtual line connecting the opposite ends of the toner container on one side wall or bottom wall of the toner container 31 in the lengthwise direction. Therefore, the direction in which the toner container 31 moves backward and the direction in which the toner T moves toward the outlet 31*e* are coincident, preventing the inertia force acting on the toner C, as stated above, from being scattered in the other directions. Stated another way, the inertia force is effectively used to discharge the toner T and allows the toner T to be discharged by a minimum of energy, thereby saving power.

Figure 14:
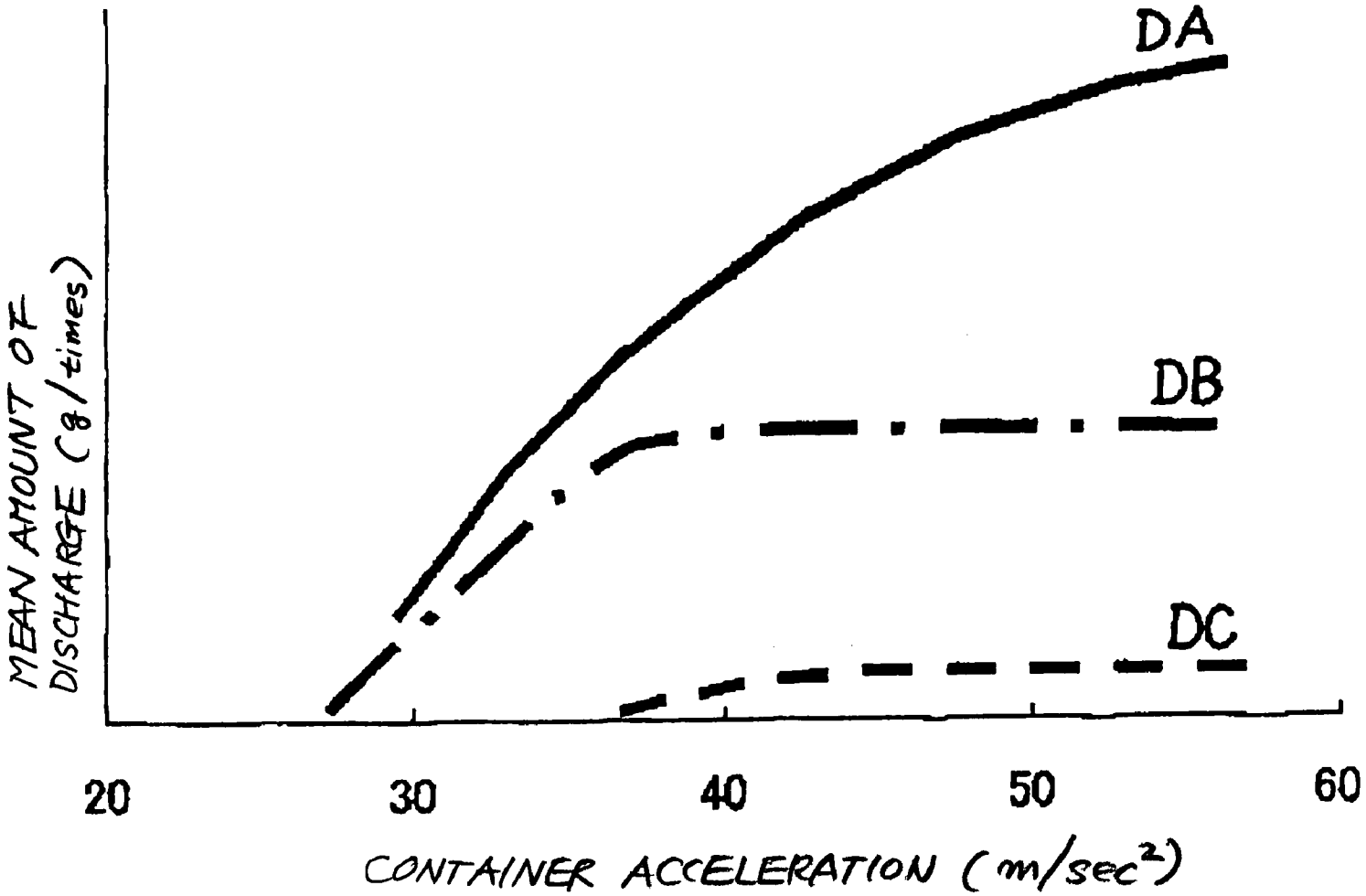
FIG. 14 is a graph showing a relation between the peak acceleration value generated in the toner container and the mean amount of toner discharged with respect to three kinds of dampers each having a particular spring constant.

The damper 37 will be described specifically hereinafter. FIG. 14 shows a relation between the peak value of the acceleration occurring in the toner container 31 and the mean amount of toner discharged with respect to three kinds of dampers 37 each having a particular spring constant. In FIG. 14, dampers DA, DB and DC have spring constants of 0.2 kgf/mm, 2 kgf/mm and 3 kgf/mm, respectively. The damper is formed of a gel-like elastomer whose hardness is almost zero in JIS (Japanese Industrial Standards)-A scale. The damper DB is formed of rubber whose hardness is 20 in JIS-A scale while the damper DC is formed of rubber whose hardness is 30 in JIS-A scale.

As FIG. 14 indicates, for a given acceleration peak value, the mean amount of toner discharged increases with a decrease in the spring constant of the damper 37. The mean amount of toner discharged is desirable when the spring constant is between 0.2 kgf/mm and 2 kgf/mm. This is presumably because when the damper 37 is soft, the duration of acceleration of 20 m/sec$^2$ or above is extended and allows the toner to be stably discharged in a sufficient amount, as will be described in relation to experimental results more specifically later.

Figure 15:
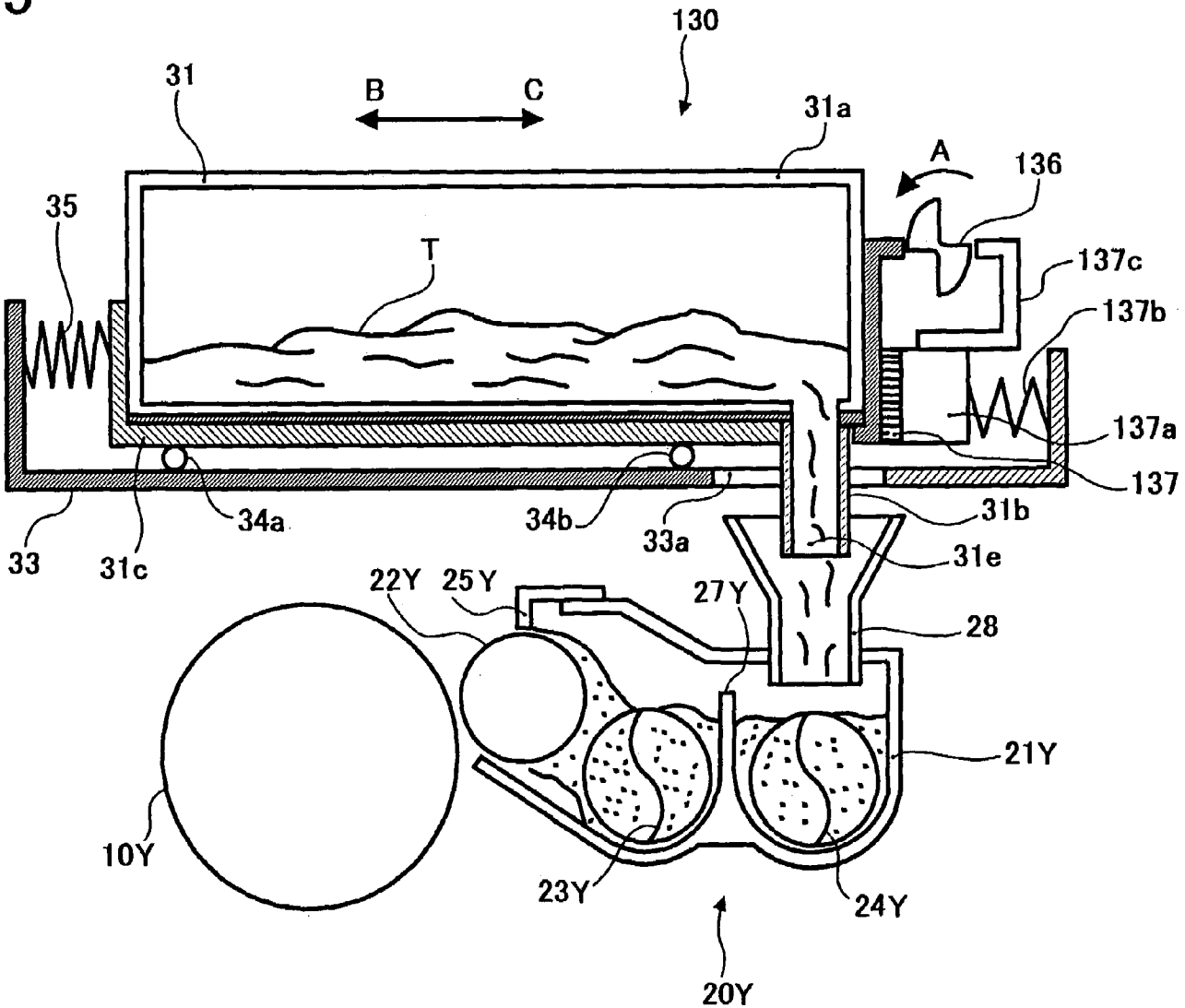
FIG. 15 is a view showing a modification of the illustrative embodiment.

FIG. 15 shows a modification of the illustrative embodiment. As shown, a toner discharging device, generally 130, differs from the device of FIG. 5 in the configuration of the cam and damper. More specifically, while the damper 37 of the illustrative embodiment is affixed to the support base 44, a damper 137 included in the modification abuts against the holder 32 while moving in the opposite direction to the toner container 31 and holder 32.

As shown in FIG. 15, a cam 136 has two eccentric cam surfaces and two stepped portions. The cam 136 is configured such that when one eccentric cam surface contacts the holder 32, the other eccentric cam surface contacts an arm 137*c* affixed to a damper support member 137*a*, which supports the damper 137, moving the holder 32 and toner container 31 and the damper 137 away from each other. When the cam 136 is rotated to a position where the two stepped portions contact the holder 32 and arm 137*c*, respectively, the holder 32 and toner container 31 and the damper 137 are moved toward each other under the action of the spring 35 and a spring 137*b*. The holder 32 is brought to a stop on abutting against the damper 137.

The modification described above also allows the mean amount of toner discharged to vary in accordance with the spring constant of the damper 137, as determined by experiments. The mean amount of toner discharged was desirable when the acceleration peak value was between 0.05 kgf/mm and 1 kgf/mm, as determined with three kinds of dampers 137 as in the illustrative embodiment. The dampers 137 used for experiments were formed of the same materials as the dampers 37 of the illustrative embodiments.

In the illustrative embodiment, assume that the entire toner container is provided with flexibility. Then, if the toner container is affixed to the holder 32 only at its mouth portion, the toner container is apt to deform due to a great acceleration when it hits against the damper 37. Such an acceleration causes the toner container to move in the direction C, FIG. 5, to thereby reduce the distance over which the toner T is expected to move in the event of collision. By contrast, the toner container 31 of the illustrative embodiment, including the rigid member 31*c* affixed to the flexible bag 31*a*, does not deform or reduce the above distance.

Experiments, conducted to determine conditions for discharging the toner T via the outlet 31*e* by a stable amount, will be described hereinafter.

To allow the toner T in the toner container 31 to move toward the outlet 31*e* and drop via the outlet 31*e* in a stable amount, it is necessary to cause the entire toner T to move toward the outlet 31*e*. However, if the acceleration to occur when the toner container 31 and holder 32 hit against the damper 37 and therefore the inertia force stated earlier is short, then the toner T separates into a portion that easily moves and a portion that does not do so. As a result, only the portion that easily moves moves toward the outlet 31*e* while the other part remains at the side of the toner container 31 opposite to the outlet 31*e*. This not only obstructs the stable discharge of the toner T via the outlet 31*e*, but also causes the toner T to partly remain in the toner container 31.

The stable discharge of the toner T via the outlet 31*e* is also obstructed when the toner T, cohered by compression, stops the upper end of the outlet 31*e*. The toner T coheres if the acceleration to occur when the toner container 31 and holder 32 hit against the damper 37 is excessively great. More specifically, if the acceleration is excessively great, then the inertia force to act on the toner container 31 is also excessively great with the result that the toner T in the toner container 31 moves toward the outlet 31*e* in an amount far larger than the amount of discharge caused by the reciprocating movement. Consequently, the toner T gathers around the outlet 31*e* and coheres little by little due to the above acceleration. In this condition, part of the toner T positioned above the outlet 31*e* simply breaks and drops while the other part around the outlet 31*e* partially or entirely blocks.

Figure 16:
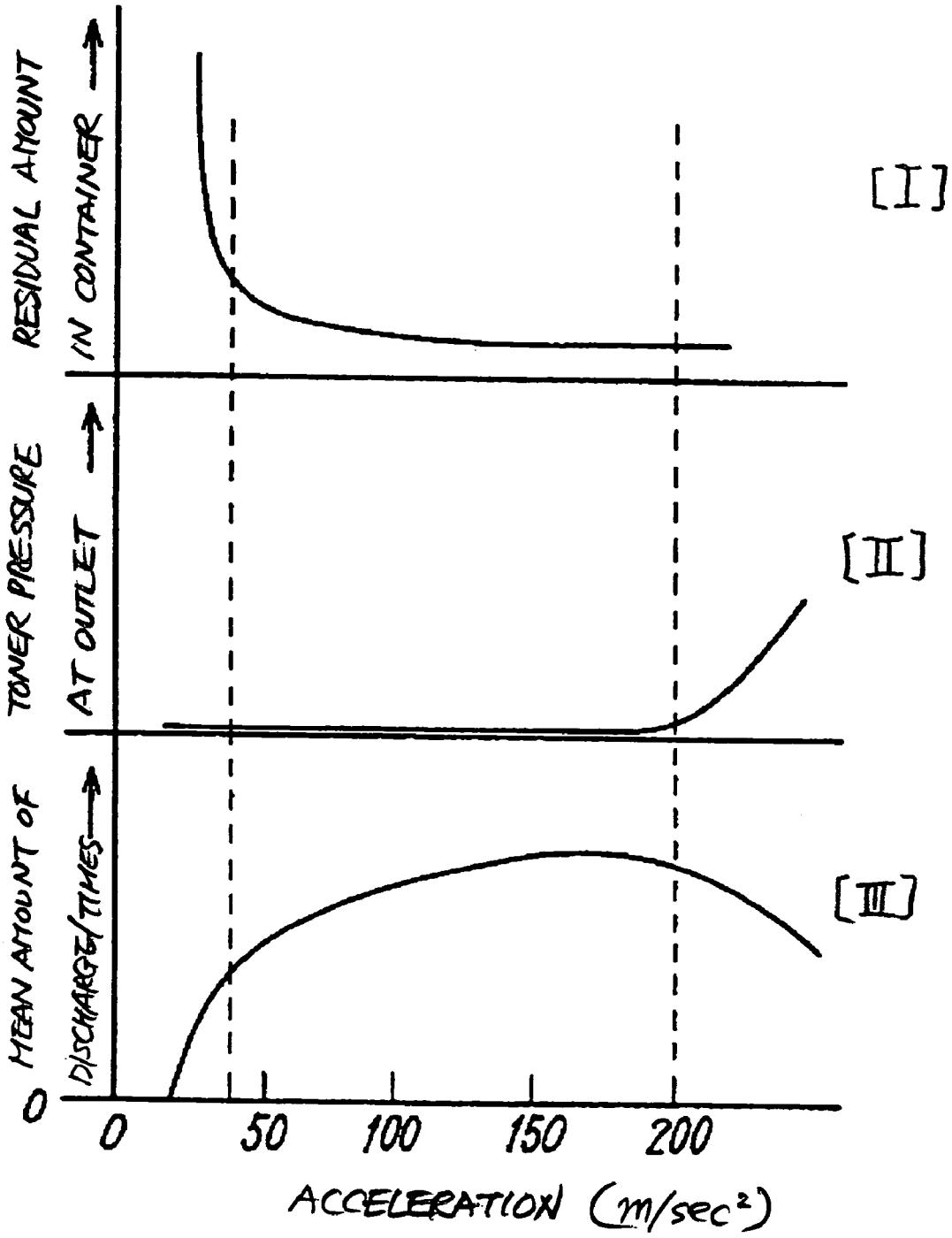
FIG. 16 is a graph showing the results of experiments conducted to determine a relation between acceleration generated when the toner container and a holder hit against the damper and the toner discharge characteristics.

To solve the above problem, it is important to adequately select the upper and lower limits of the acceleration to occur when the toner container 31 and holder 32 hit against the damper 37. It is to be noted that the above acceleration refers to a peak acceleration value to occur at the time of collision, i.e., a value D shown in FIG. 13. FIG. 16 shows a relation between the acceleration D and the discharge characteristics of the toner T determined by experiments. For a given spring 35 and a given cam 36, the acceleration D to occur at the time of collision is dependent on the weight of the toner container 31. More specifically, because the weight of the toner container 31 decreases little by little in accordance with the discharge of the toner T, the acceleration D increases little by little. In light of this, the spring 35 and cam 36 were so adjusted as to maintain the acceleration D constant without regard to the weight of the toner container 31.

In FIG. 16, [I] shows a relation between the acceleration D and the amount of the toner T left in the toner container 31 after discharge. As shown, if the acceleration D is smaller than 40 m/sec$^2$, then much toner T is left in the toner container 31 without being discharged. More specifically, it was experimentally found that the inertia force derived from such an acceleration was too weak for the toner T to bodily move toward the outlet 31*e* in the toner container 31.

In FIG. 16, [II] shows a relation between the acceleration D and pressure acting on the toner T around the outlet 31*e*. As shown, if the acceleration D is 200 m/sec$^2$ or below, then the pressure acting on the toner T is low enough to prevent the toner T from cohering. When the acceleration D exceeds 200 m/sec$^2$, the pressure sharply increases and causes the toner T to cohere.

In FIG. 16, [III] shows a relation between the acceleration D and the amount of the toner T discharged for every collision. As shown, the toner T starts being discharged when the acceleration D is around 20 m/sec$^2$, and is discharged in a larger amount as the acceleration D becomes greater. However, when the acceleration D exceeds 200 m/sec$^2$, the amount of discharge decreases.

The experimental results stated above indicate that to discharge the toner T via the outlet 31*e* by a stable amount, the acceleration D should preferably be confined in the range of from 40 m/sec$^2$ to 200 m/sec$^2$.

However, it was experimentally found that even when the acceleration peak value D was 40 m/sec$^2$ or above, the amount of discharge via the outlet 31*e* was sometimes short. On the other hand, it was found that a period of time t over which the acceleration of 20 m/sec$^2$ or above continues was correlated to the amount of discharge more than the other factors, as will be described hereinafter.

Figure 17:
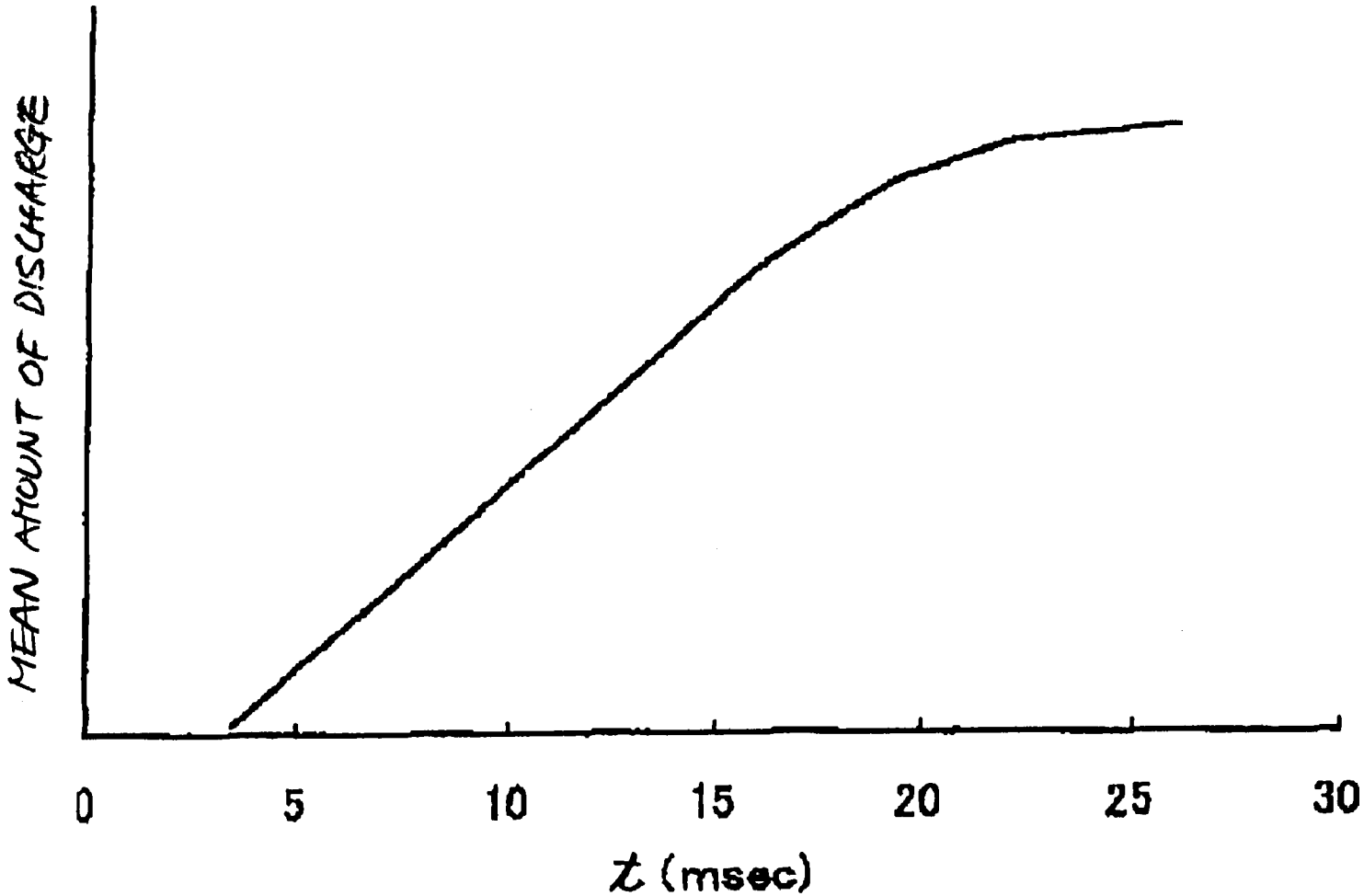
FIG. 17 is a graph showing how the mean amount of toner discharge varies when the acceleration peak value of the toner container is fixed at 40 m/sec$^2$, but the duration of an acceleration of 20 m/sec$^2$ or above is generated is varied.

FIG. 17 shows how the mean amount of discharge varied in accordance with the period of time t when the peak acceleration value was fixed at 40 m/sec$^2$. The period of time t was varied in terms of the spring constants of the spring 35 and damper 37. As shown, when the period of time t was shorter than 3 msec, the discharge of the toner T was unstable. The amount of discharge became stable when the period of time t was 3 msec or above, and increased with an increase in the period of time t. While the spring constant of the damper 37 must be reduced, i.e., the damper 37 must be made soft for increasing the period of time t, the upper limit of the period of time t is about 30 msec because the damper 37, in practice, should not be excessively soft.

As stated above, the toner T can be stably discharged if the maximum acceleration is between 40 m/sec$^2$ and 200 m/sec$^2$ and if the period of time t over which the acceleration of 20 m/sec$^2$ or above acts on the toner container 31 is between 3 msec and 30 msec.

The toner T can be stably discharged if the acceleration to act on the toner container 30 is adequately selected, and can be discharged in a large amount if the peak acceleration value is increased, as stated above. However, if the peak acceleration value is increased for the above purpose, then vibration ascribable to the collision of the toner container 31 against the damper 37 increases, increasing vibration to be imparted to the printer body to thereby lower image quality. The peak acceleration value should therefore be as small as possible. By extending the period of time t, it is also possible to increase the amount of discharge, as stated in relation to the experiments. It follows that by adequately selecting the period of time t, it is possible to implement a desired amount of discharge while reducing the above vibration.

Extended researches and experiments showed that if a speed variation of 0.1 m/sec to 0.6 m/sec occurred when the above acceleration was acting on the toner container 31, then a desired amount of discharge was achievable with vibration being reduced. The speed variation mentioned above corresponds to the time-integrated value of the variation of acceleration shown in FIG. 13. Therefore, it is possible implement the desired amount of discharge while damping vibration if the maximum acceleration value and period of time t are adequately selected.

It is to be noted that the size of vibration to be imparted to the printer body is dependent on the size of a mass hitting against the damper as well. Experiments showed that if the total weight of the toner container 31, toner T stored therein and holder 32 was between 0.3 kgf and 2 kgf, then great vibration, effecting image quality, could be sufficiently damped.

As stated above, the illustrative embodiment allows the toner T in the toner container 31 to surely move to the outlet 31*e* without remaining at the side opposite to the outlet 31*e*.

Second Embodiment

This embodiment is directed toward the second object stated earlier. The description made with reference to FIGS. 3 through 5 and 13 through 17 substantially directly apply to this embodiment as well; identical structural parts and elements are designated by identical reference numerals and will not be described in order to avoid redundancy.

Figure 18:
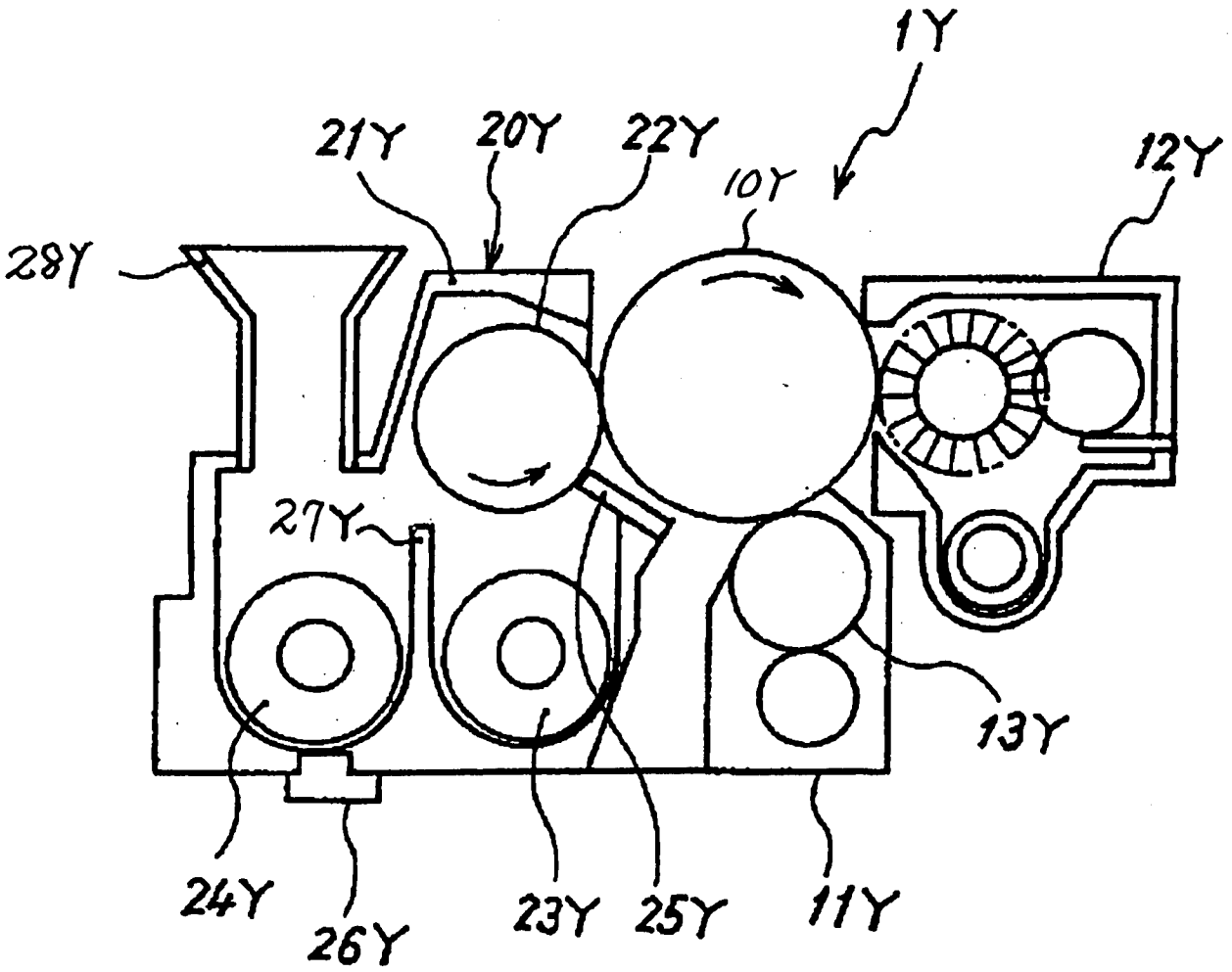
FIG. 18 is a view showing a yellow process unit included in a second embodiment of the present invention.

As shown in FIG. 18, in the illustrative embodiment, a toner hopper 28Y, flared upward, is positioned above the second developer chamber and communicates the second developer chamber to the outside of the developing device 20Y. The Y toner discharged from the Y toner discharging device, not shown, drops into the toner hopper 28Y and then reaches the second developer chamber.

Figure 19:
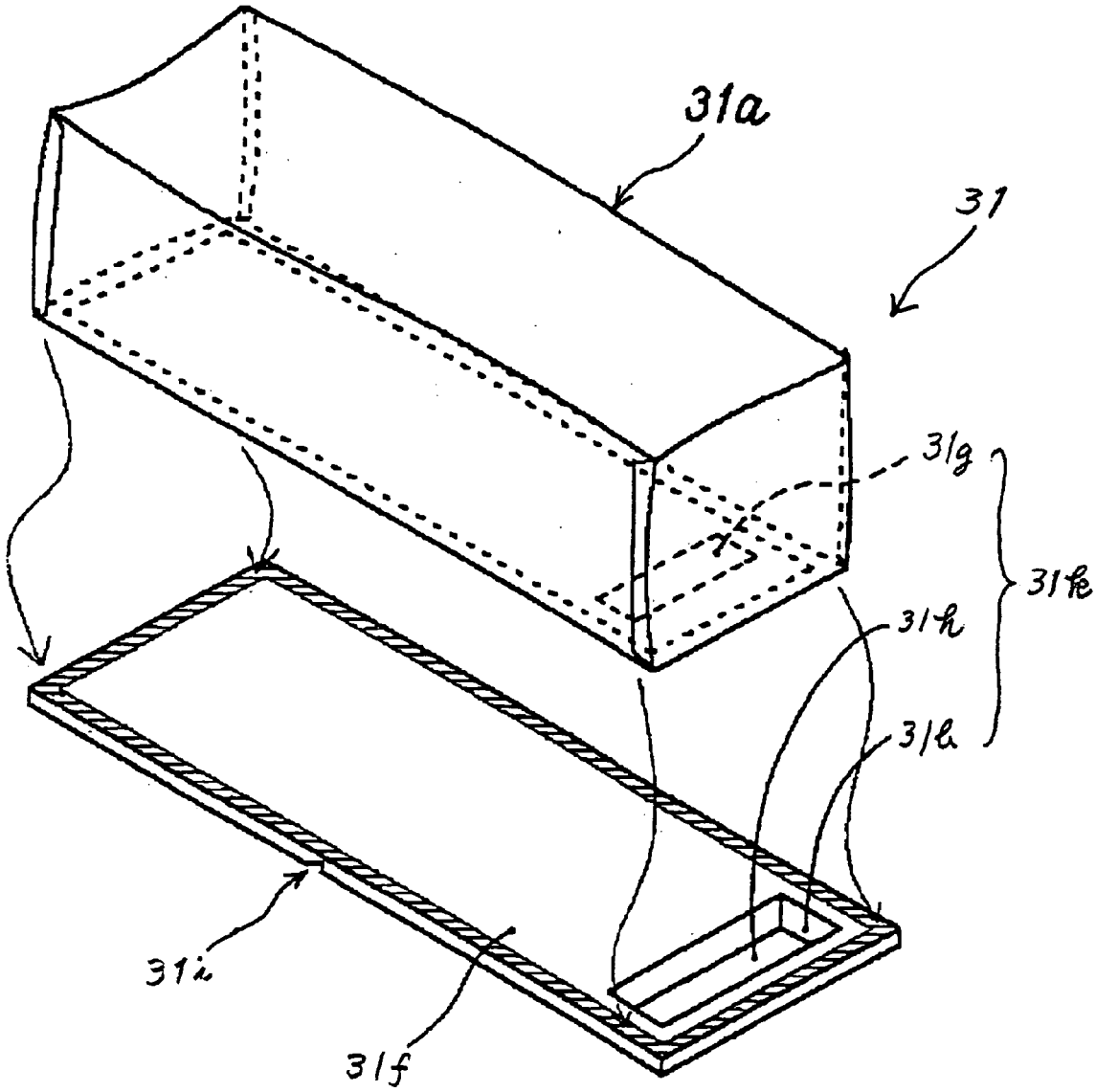
FIG. 19 is an exploded perspective view showing a yellow toner cartridge included in the second embodiment.

FIG. 19 shows a toner cartridge or powder container 31 included in the illustrative embodiment. As shown, the toner cartridge 31 includes a flexible bag 31*a* and a reinforcing plate 31*f*. The bag 31*a*, having a rectangular configuration, is formed of polyethylene, nylon or similar deformable material and provided with thickness of about 80 μm to 200 μm. The bag 31*a*, accommodating toner or powder therein, is laid in the horizontal direction when used. An opening 31*g* is formed in one end portion of the bag 31*a* and directed vertically downward. The reinforcing plate 31*f* is 0.5 mm thick or above and adhered or otherwise affixed to the outer bottom surface of the bag 31*a*, preventing only the bottom of the bag 31*a* from deforming.

An opening 31*h* is formed in the reinforcing plate 31*f* in alignment with the opening 31*g* of the bag 31*a*. A projection 31*b*, extending vertically downward, is formed integrally with or adhered to the bottom plate 31*f* around the opening 31*h*. The openings 31*g* and 31*h* and projection 31*b* constitute an outlet 31*k* directed vertically downward and communicating the inside of the bag 31*a* to the outside.

The projection 31*b* may not be provided on the reinforcing plate 31*f*, but may be provided on the bag 31*a* and fitted in the opening 31*g* of the reinforcing plate 31*f*. In any case, if the bag 31*a*, reinforcing plate 31*f* and projection 31*b* are formed of the same material, then the entire toner cartridge 31 can be formed of a single material. This, coupled with the flexibility of the bag 31*g*, is also successful to facilitate recycling of the toner cartridge 31 and reduces transport cost, as stated in relation to the previous embodiment.

If the deformable bag 31*a* is used as a toner cartridge alone, then it easily bends in the lengthwise direction even when filled up with toner and is therefore difficult to handle. This is why the reinforcing plate 31*f* is affixed to the bottom of the bag 31*a*. The toner cartridge 31 with the reinforcing plate 31*f* can be easily mounted to the toner discharging device, which will be described specifically later.

Figure 20:
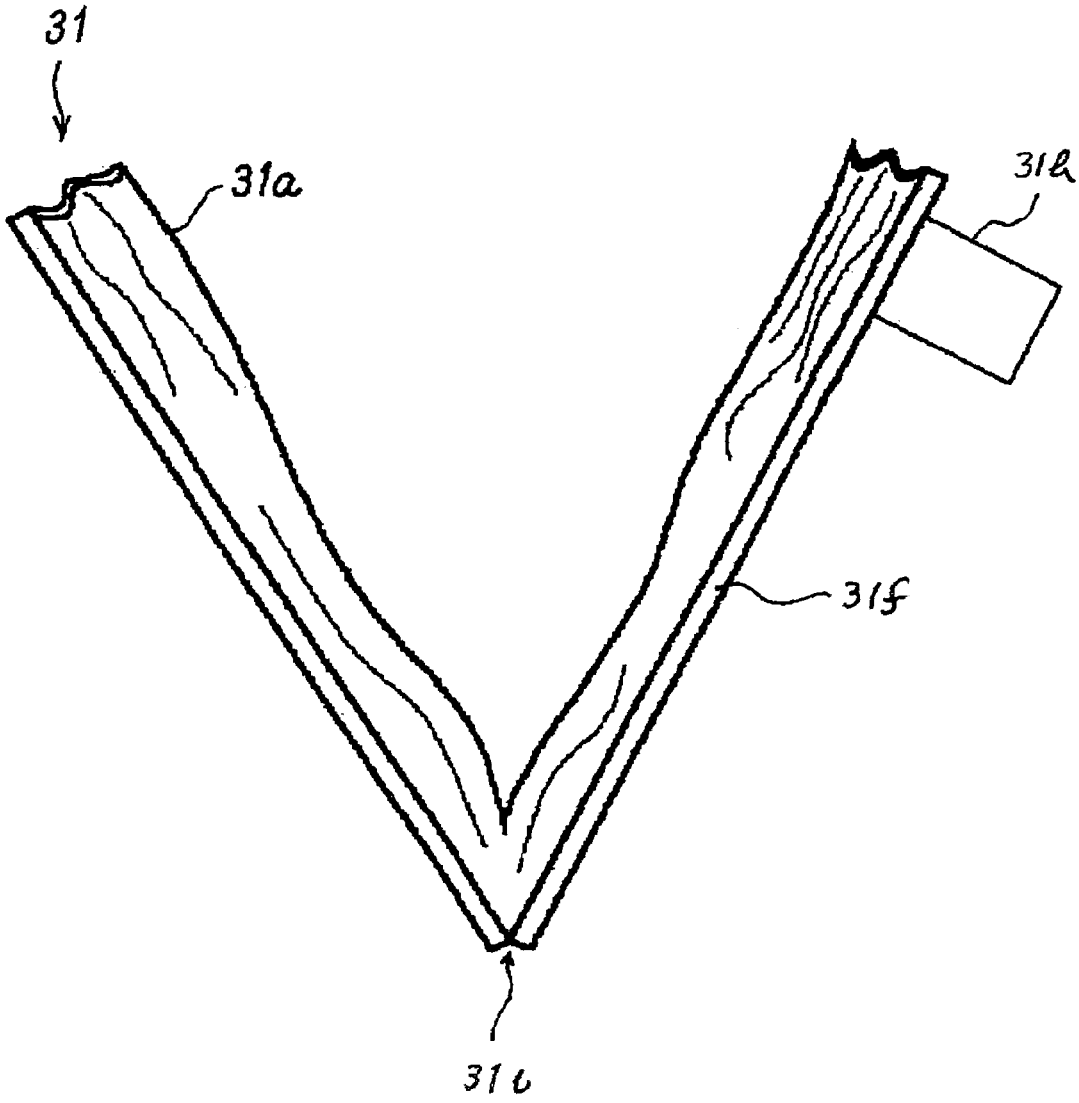
FIG. 20 is a side elevation of the yellow toner cartridge with a reinforcing plate held in a folded position.

A notch 31*i* is formed in the reinforcing plate 31*f* at the center in the lengthwise direction and extends in the widthwise direction. As shown in FIG. 20, after the bag 31*a* has run out of toner and decreased in volume, it is possible to fold down the reinforcing plate 31*f* and therefore the entire toner cartridge 31 along the notch 31*i* in a compact configuration. If desired, a plurality of notches 31*i* may be formed in the reinforcing plate 31*f*. Also, the notch 31*i* may extend in the lengthwise direction of the reinforcing plate 31*f*, so that the toner cartridge 31 can be folded down in the widthwise direction.

Figure 21:
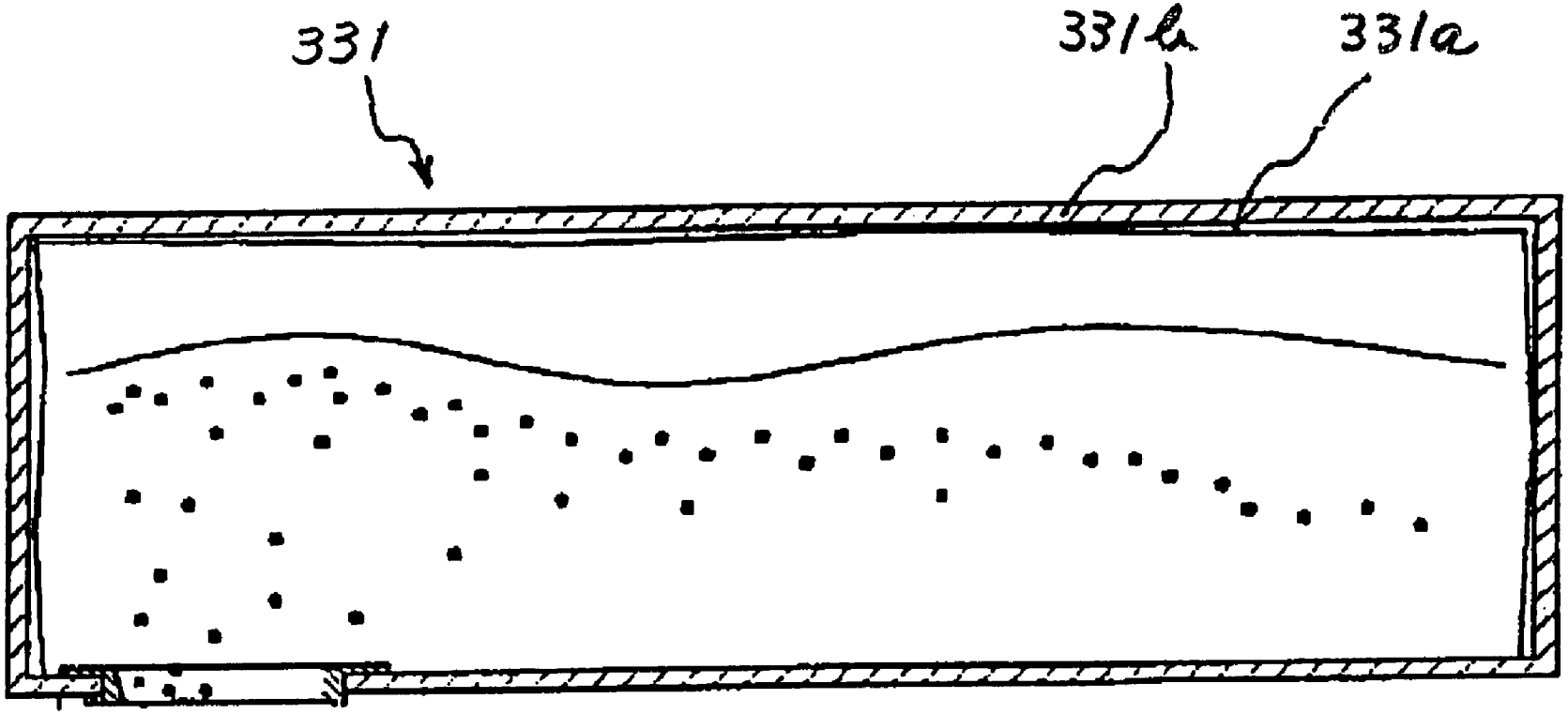
FIG. 21 is a section showing a modification of the toner cartridge.

FIG. 21 shows a modification of the toner cartridge 31. As shown, a toner cartridge 331 is made up of a non-deformable box 331*b* and a deformable bag 331*a* disposed in the box 331*b*. A mouth portion is positioned around the opening of the bag 331*a* and fitted in an opening formed in the bottom wall of the box 331*b*, whereby the bag 331*a* is affixed to the box 331*b*. The box 331*b* is separable into the bottom wall and a cover portion constituting a top wall and side walls, allowing the bag 331 to be replaced when it runs about of toner. With this configuration, the toner cartridge 331 not only achieves the same advantages as the toner cartridge 31, but also reduces toner replenishing cost because the bag 331*a* should be replaced alone. If desired, an air filter may be fitted on the bag 331*a*, so that the volume of the bag 331*a* can automatically decrease in accordance with the consumption of toner.

The toner discharging device of the illustrative embodiment also has the configuration described with reference to FIG. 5. The configuration of the cam 36 will be described more specifically hereinafter. The cam 36 includes the stepped portion 36*b*. The distance between the axis of the cam 36 and the eccentric cam surface 36*a* increases from the stepped portion 36*b* little by little in the counterclockwise direction, as seen in FIG. 5, and then the maximum radius sharply decreases to the minimum radius at the stepped portion 36*b*. When the cam 36 is rotated with the eccentric cam surface 36*a* contacting the right wall of the holder 32, the cam 36 moves the holder 32 leftward, as viewed in FIG. 5, against the bias of the spring 35, as stated earlier. The operation of the toner discharging device will not be further described in order to avoid redundancy. In the illustrative embodiment, the spring 35, cam 36, drive means for driving the cam 36 and damper 37 constitute shock applying means for applying a shock to the toner cartridge 31 while causing it to reciprocate.

Figure 22:
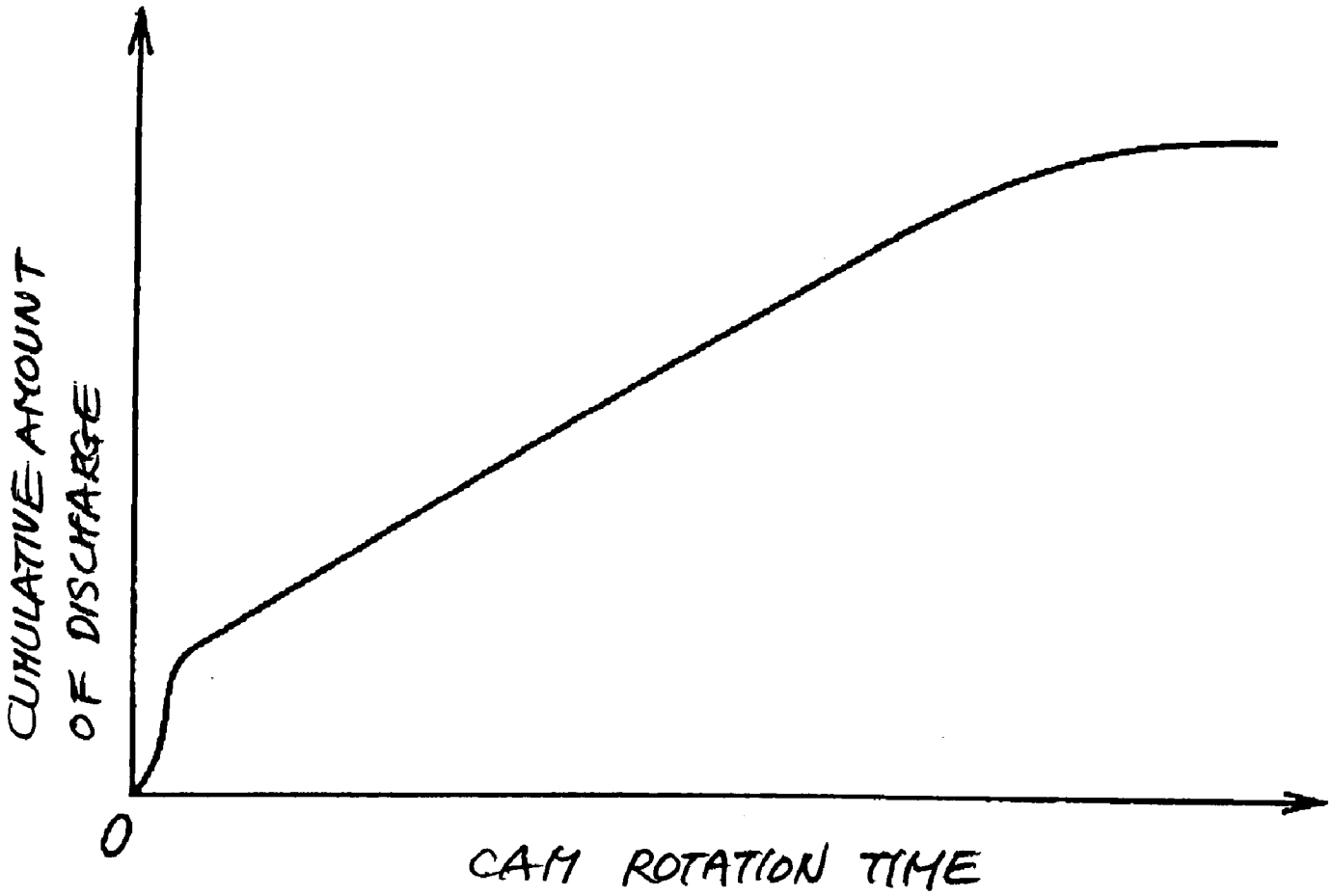
FIG. 22 is a graph showing a relation between the cumulative amount of toner discharged from the toner cartridge and the duration of rotation of a cam included in the illustrative embodiment.

FIG. 22 shows a relation between the cumulative amount of toner discharged from the toner cartridge 31 and the duration of continuous rotation of the cam 36. The cumulative amount of toner discharged is measured by continuously rotating the cam 36 from the time when a new toner cartridge 31 is set to the time when the cartridge 31 runs out of toner. As shown, a curve shown in FIG. 22 sharply rises for some period of time just after the toner cartridge 31 has been set, indicating that the amount of toner discharged for a unit time is extremely large. This is because part of the toner positioned right above the outlet 31*e* drops at a time due to gravity. Subsequently, the amount of discharge for a unit time becomes stable, i.e., the cumulative amount of discharge increases in proportion to the duration of rotation of the cam 36. When the cam 36 is further rotated, the toner, remaining in the toner cartridge 31, decreases in amount until it has been mostly discharged.

The description made with reference to FIGS. 13 through 17 apply to the illustrative embodiment as well.

Figure 23:
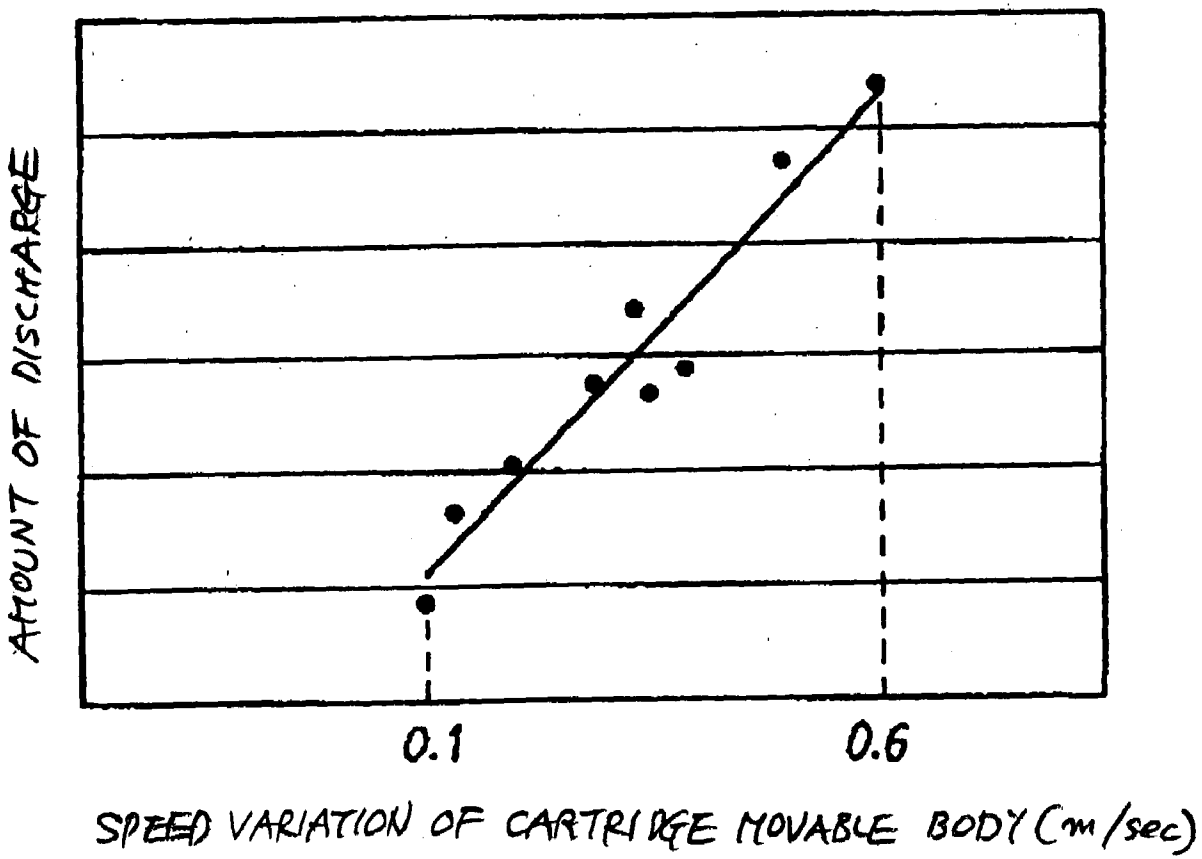
FIG. 23 is a graph showing the amount of toner discharged from the toner cartridge and the speed variation of a cartridge movable body.

FIG. 23 shows a relation between the amount of toner discharged from the toner cartridge 31 and the speed variation of the toner cartridge 31 and holder 32, which will be collectively referred to as a cartridge movable body hereinafter. As shown, if the speed variation of the cartridge movable body at the time of collision is between 0.1 m/sec and 0.6 m/sec, then stable discharge is achievable, i.e., the amount of toner discharged increases in accordance with the speed variation.

We, however, found that even when the speed variation of the cartridge movable body at the time of collision was 0.6 m/sec, the amount of discharge was sometimes short. Further experiments showed that when toner grains had a relatively low mean circularity, a sufficient amount of discharge was not attained when the speed variation was between 0.1 m/sec and 0.6 m/sec. This is presumably because a frictional force, acting between the toner grains, increases with a decrease in circularity and makes it difficult for the toner grains to move when subjected to the inertia force.

Figure 24:
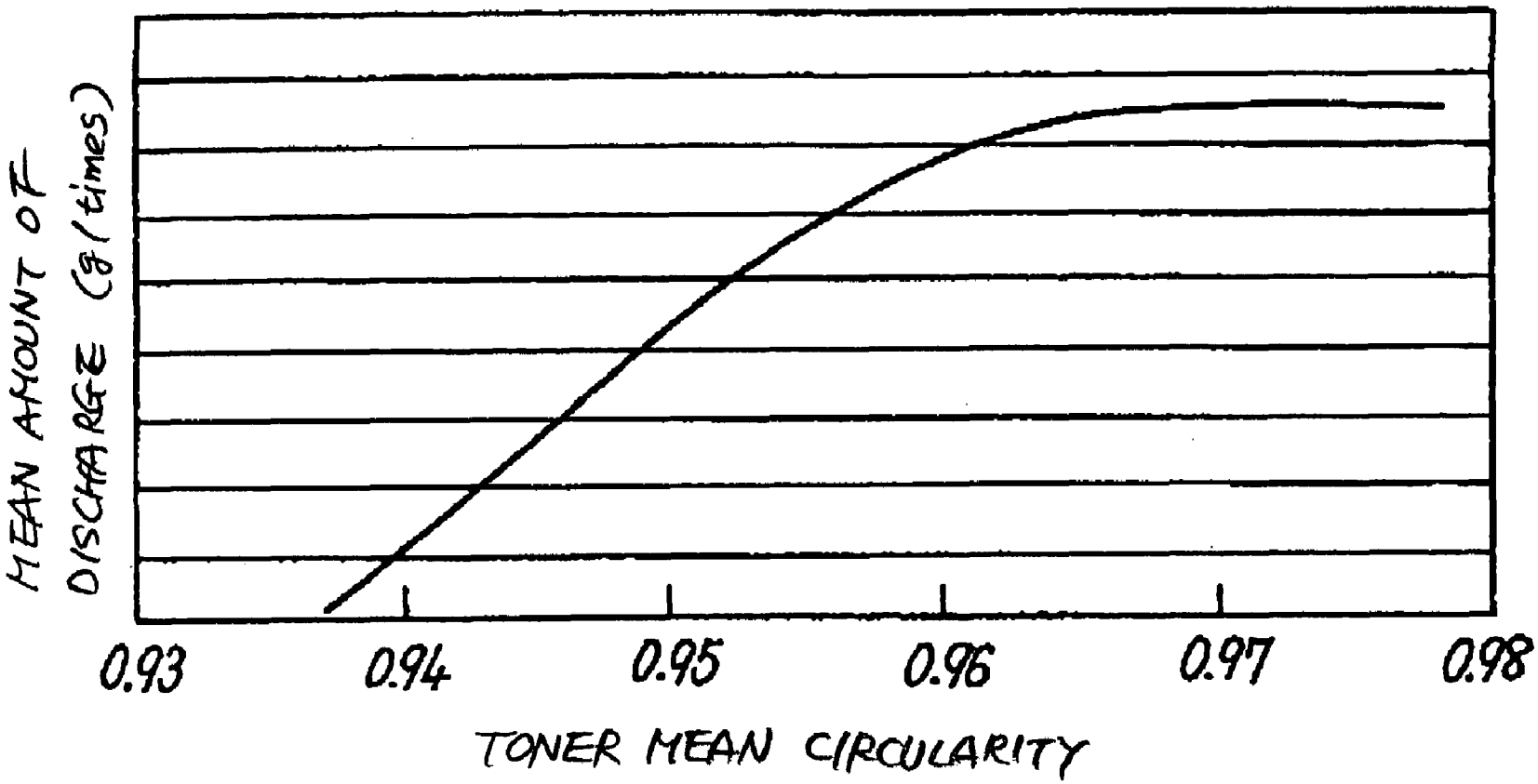
FIG. 24 is a graph showing a relation between the mean circularity of toner and the amount of toner discharged when the speed variation is fixed at 0.35 m/sec.

In light of the above, we examined a relation between the circularity of toner grains and the amount of toner discharged while fixing the speed variation at 0.35 m/sec. FIG. 24 shows the result of examination. As shown, toner grains are discharged little when their mean circularity is generally lower than 0.937. Also, so long as the mean circularity is generally between 0.937 and 0.965, stable toner discharge is achieved; the higher the mean circularity, the larger the amount of toner discharged. Further, when the mean circularity exceeds 0.965, the amount of toner discharge does not increase any further.

When the speed variation was fixed at 0.60 m/sec higher than 0.35 m/sec, the curve of FIG. 24 generally shifted to the left, meaning that stable toner discharge was attained despite the lower mean circularity. On the other hand, when the speed variation was fixed at 0.10 m/sec or lower limit, the curve of FIG. 24 generally shifted to the right; stable toner discharge is not achievable unless toner with a higher mean circularity is used. When the mean circularity was lower than about 0.94, toner was discharged little. When the mean circularity was between 0.94 and 0.96, toner was stably discharged. Although toner can be stably discharged even when the mean circularity is above 0.96, the amount of toner discharge cannot increase with an increase in mean circularity. It follows that the most desirable toner discharge is attainable when the mean circularity is 0.96 or above.

The illustrative embodiment uses, based on the experimental results stated above, toner whose mean circularity is between 0.94 and 1.00 and causes a speed variation of 0.1 m/sec or above, but 0.6 m/sec or below, to occur in the cartridge movable body when the movable body hits against the damper 137. Further, the cartridge movable body of the illustrative embodiment has a weight of 0.3 kgf or above (when run out of toner), but 2 kgf or below (when filled up with toner). Under these conditions, it is possible to desirably discharge toner from the toner cartridge even when the shock to act on the toner cartridge is of a degree not adversely influencing image quality.

To measure the mean circularity of toner grains, use was made of a flow-type particle image analyzer FPIA-2100 available from SYSMEX. For measurement, 0.1 ml to 0.5 ml of alkylbenzenesulfonate or surfactant was added to 100 ml to 150 ml of water, and then 0.1 g to 0.5 g of toner powder was added to the resulting mixture. The resulting suspension was dispersed for about 1 minutes to 3 minutes in an ultrasonic disperser to dispersion density of 3,000/μl to 10,000/μl, and then analyzed by the above analyzer. The mean circularity was determined on the basis of the mean value of circularities produced by dividing the circumferential length of a circle having the same area as the projected area of a toner grain by the circumferential length of the projected image.

While the foregoing description has concentrated on a printer using a toner and carrier mixture, the illustrative embodiment is similarly applicable to a developing system using only toner, i.e., a one-component type developer. Also, the illustrative embodiment may be implemented as a copier, facsimile apparatus or similar image forming apparatus other than a printer. Further, exposure using a laser beam may be replaced with exposure using an LED (Light Emitting Diode) array or ions, if desired.

The illustrative embodiment is applicable even to an image forming system not using the electrophotographic process, e.g., a direct recording system taught in Japanese Patent Laid-Open Publication No. 11-301014 by way of example. Moreover, the illustrative embodiment is practicable with a system that replenishes toner to a developing device with a suction pump or similar conveying means. This is also true with a third embodiment to be described later.

In the illustrative embodiment, polymerized toner can be more stably discharged than pulverized toner for the following reason. Pulverized toner is produced by pulverizing mother toner to a desired grain size and is therefore low in the circularity of the individual toner grain. As a result, even if the mean circularity of the toner grains is 0.94 or above, it is difficult to stably discharge the toner due to noticeable irregularity in the circularity of the individual toner grain. By contrast, polymerized toner has a narrow circularity distribution and can therefore be stably discharged.

As stated above, the illustrative embodiment is capable of desirably discharge toner from the powder container even when a shock, applied to the powder container by the shock applying means, is so small as not to adversely influence image quality.

Third Embodiment

This embodiment is directed toward the third object stated earlier. The laser beam printer shown in FIG. 3 and process unit shown in FIG. 18 directly apply to the illustrative embodiment as well; identical structural parts and elements are designated by identical reference numerals and will not be described in order to avoid redundancy.

Figure 25:
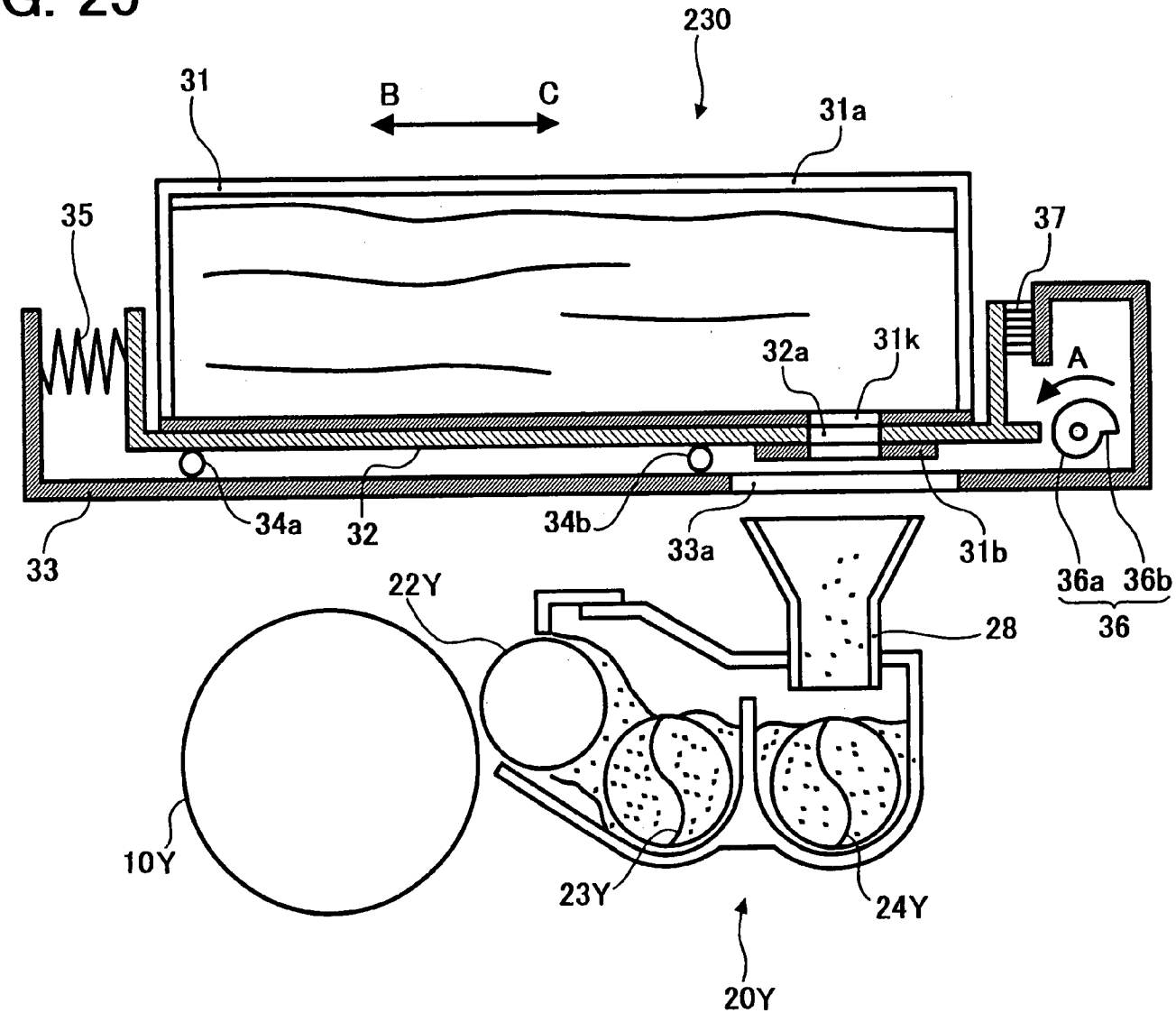
FIG. 25 is a view showing a toner discharging device representative of a third embodiment of the present invention.
Figure 26:
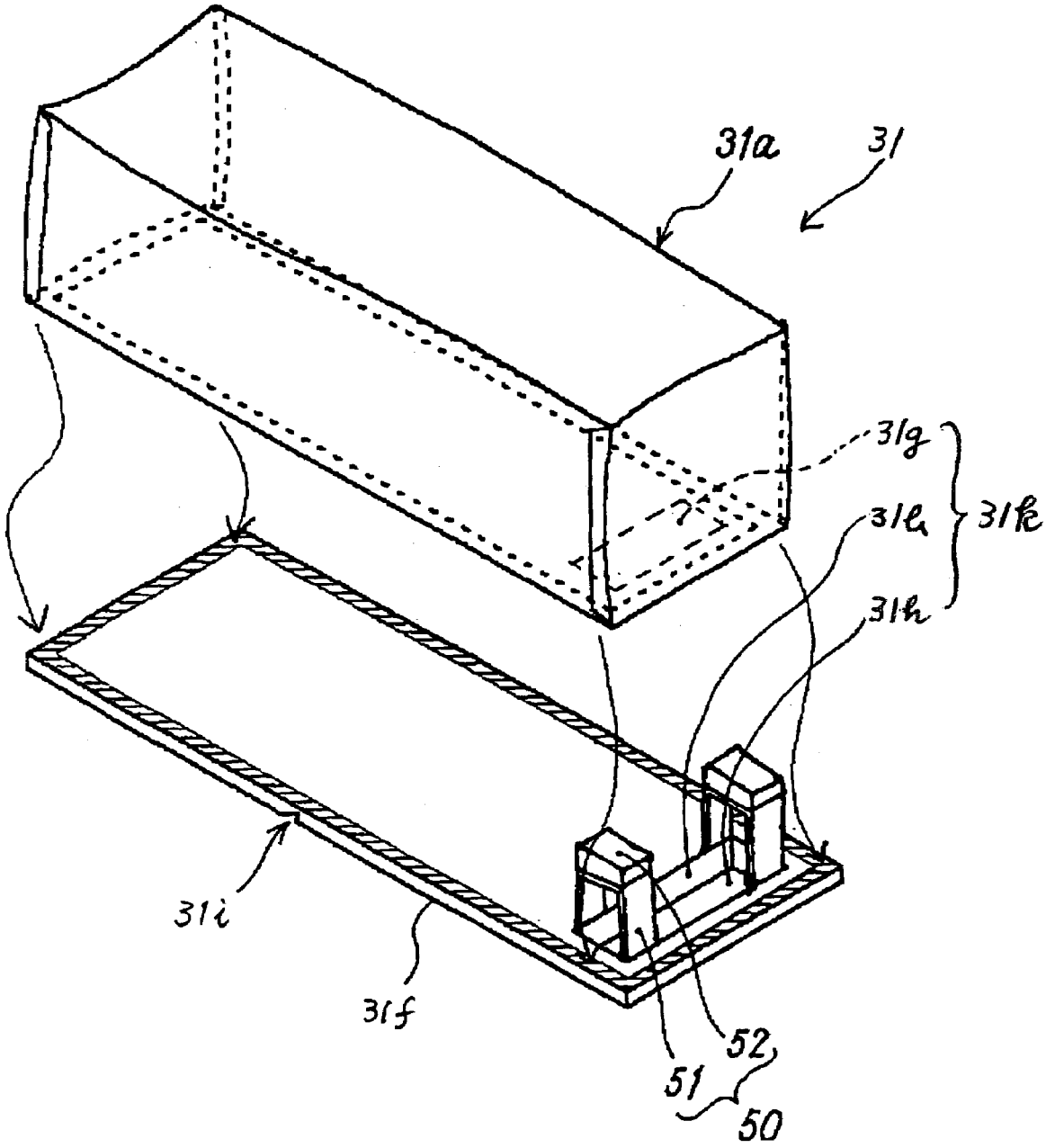
FIG. 26 is an exploded perspective view of a toner cartridge included in the third embodiment.

As shown in FIG. 25, a toner discharging device 230, assigned to the yellow developing device, not shown, by way of example, includes a toner cartridge 31, a holder 32, a support base 33, and an agitating member 50, see FIG. 26. The positional relation between the toner cartridge 31, holder 32 and support base 33 are the same as in the previous embodiments.

As shown in FIG. 26, the toner cartridge 31 includes a flexible bag 31*a* having a rectangular configuration and a reinforcing plate 31*f*. The bag 31*a* is formed of polyethylene, nylon or similar deformable resin or paper in a single layer or a laminate structure, which is 80 μm to 200 μm thick or so. The bag 31*a*, storing toner therein, is laid in the horizontal direction when used. An opening 31*g* is formed in one end portion of the bag 31*a* and oriented vertically downward. The reinforcing plate 31*f* is adhered or otherwise affixed to the outer bottom surface of the bag 31*a*, preventing only the bottom of the bag 31*a* from deforming.

An opening 31*h* is formed in the reinforcing plate 31*f* in alignment with the opening 31*g* of the bag 31*a*. A mouth portion 31*b*, projecting vertically downward, is formed integrally with the reinforcing plate 31*f* around the opening 31*h*. The openings 31*g* and 31*h* and mouth portion 31*b* constitute an outlet 31*k* directed vertically downward and communicating the inside of the bag 31*a* to the outside.

Figure 27:
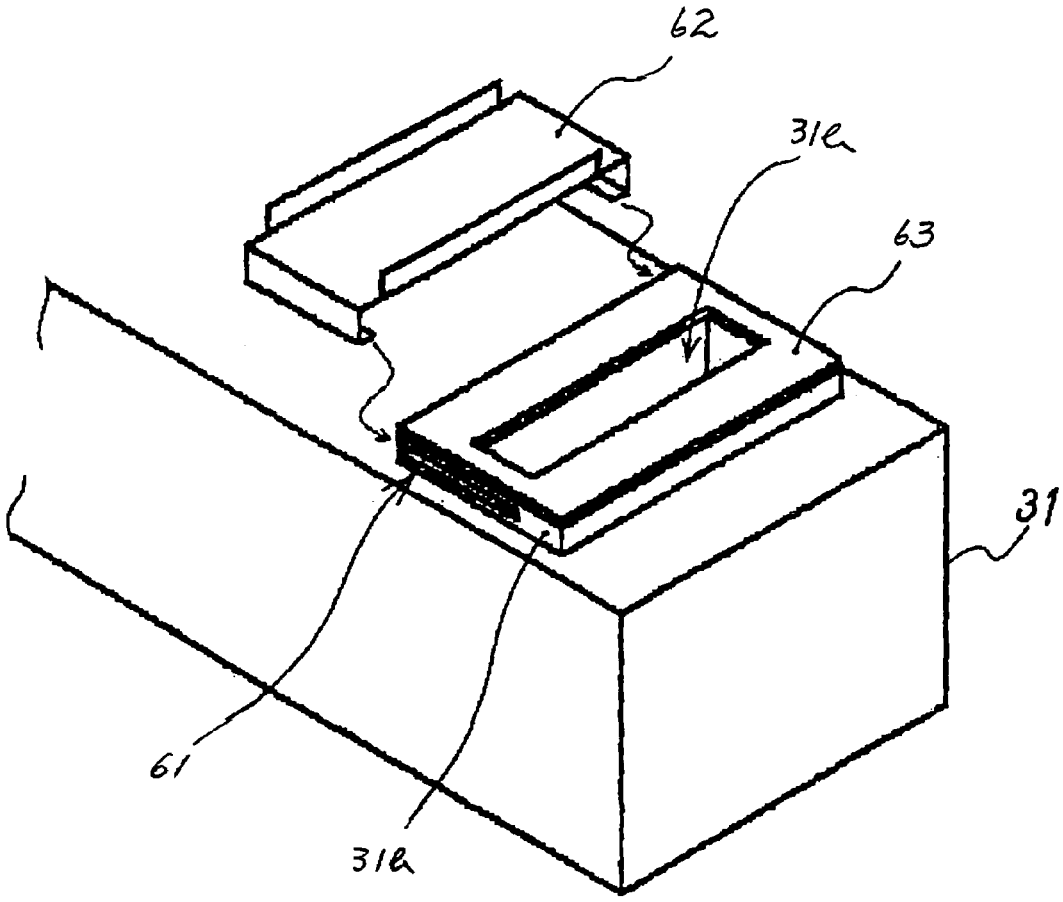
FIG. 27 is a fragmentary isometric view showing the toner cartridge provided with a shutter.

As shown in FIG. 27, a shutter 62 may be attached to the outlet 31*k* of the toner cartridge 31, if desired. The shutter 62 is guided by a pair of rails 61 (only one is visible). A seal member 63 is fitted on the underside of the mouth portion 31*b* in order to seal the shutter 61.

To mount the toner cartridge 31 to the toner discharging device 230, the holder 32, removed from the device 230 beforehand, and the toner container 31 are joined together. More specifically, as shown in FIG. 25, the mouth member 31*b* of the toner container 31 is inserted into an opening 32*a* formed in the holder 32. The mouth portion 31*b* is then inserted into the opening 33*a* formed in the support base 33, so that the toner container 31 is set on the toner discharging device 230 via rollers 34*a* and 34*b*. In this condition, the outlet 31*b* of the toner cartridge 31 is oriented vertically downward.

The opening 32*a* of the holder 32 is so configured as to restrict the movement of the outlet 31*b* in the opening 32*a*. On the other hand, the opening 33*a* of the support base 33 is so configured as to allow the outlet 31*b* to move in the opening 33*a* on the support base 33 together with the holder 32 in directions B and C, as indicated by a double-headed arrow.

As shown in FIG. 25, Toner cartridge moving means or shock applying means included in the illustrative embodiment is essentially similar to the toner cartridge moving means of the first embodiment and will not be described specifically in order to avoid redundancy. Also, a cam 36, included in the illustrative embodiment, is configured in the same manner as in the first embodiment and causes the toner in the toner cartridge 31 to be discharged via the outlet 31*k* on the basis of the same mechanism as stated earlier.

Figure 28:
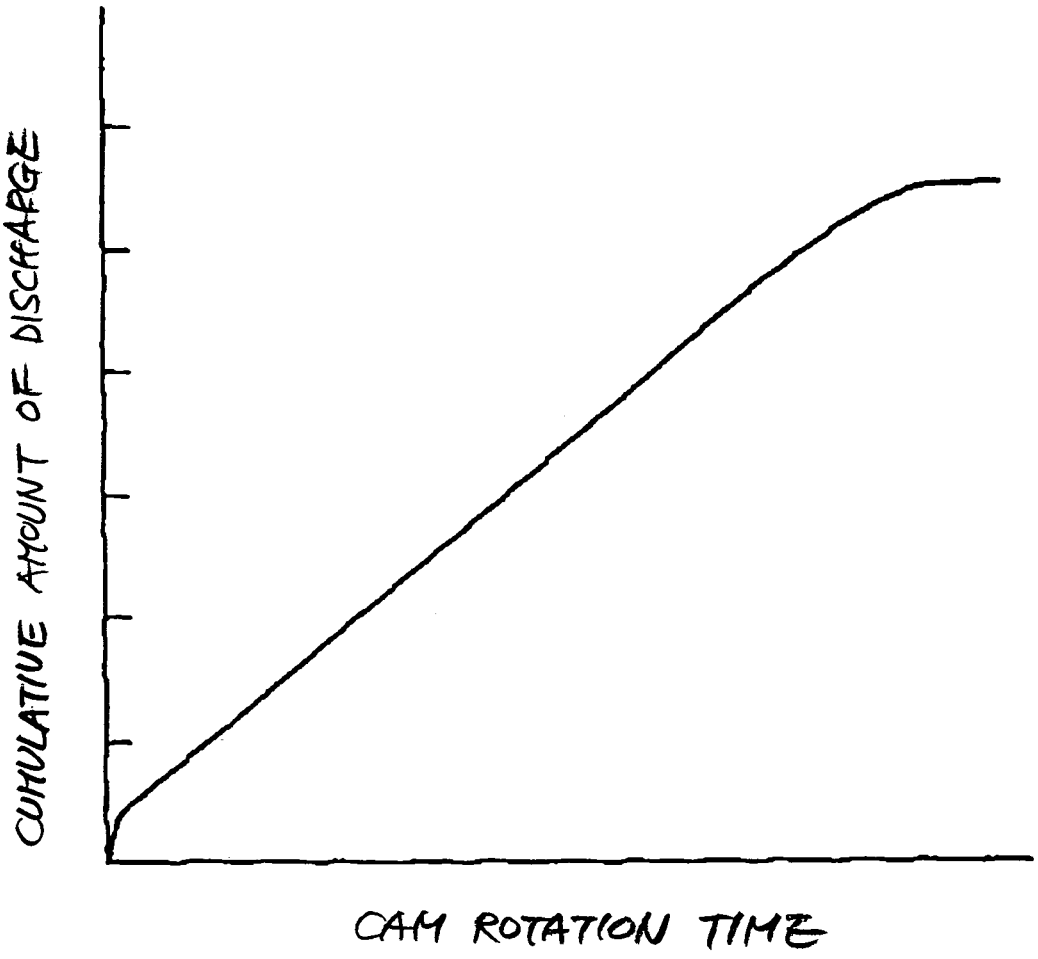
FIG. 28 is a graph showing a relation between the cumulative amount of toner discharged from the toner cartridge and the duration of rotation of a cam included in the third embodiment.

FIG. 28 is a graph similar to FIG. 22, showing a relation between the cumulative amount of toner discharged from the toner cartridge 31 of the illustrative embodiment and the duration of continuous rotation of the cam 36. Generally, the description made with reference to FIG. 22 earlier applies to FIG. 28 as well. The variation of acceleration, which acts on the toner cartridge 31 during one rotation of the cam 36, with respect to time has also been stated earlier with reference to FIG. 13.

Figure 29:
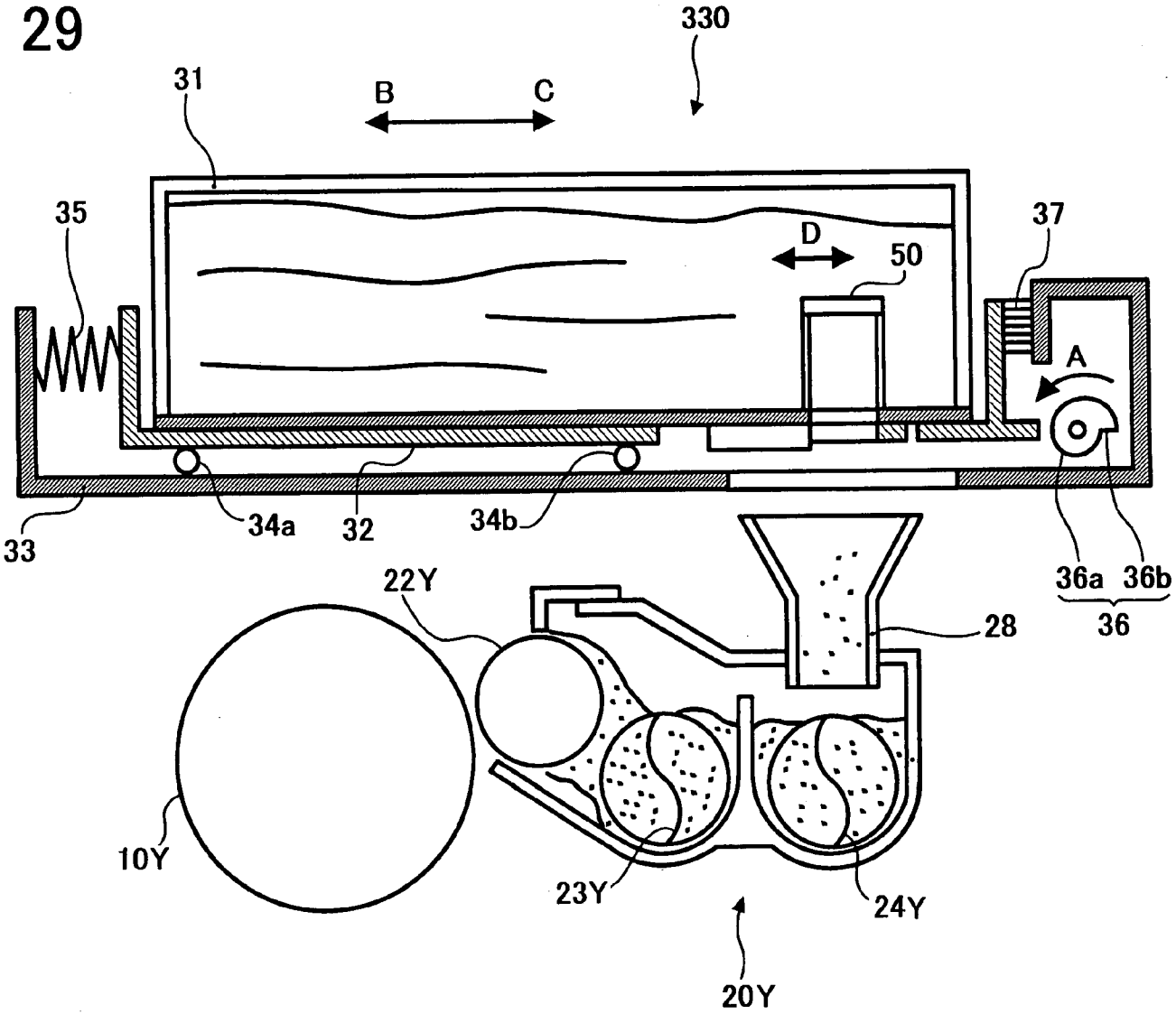
FIG. 29 is a view showing a modification of the third embodiment.

The agitating member 50, characterizing the illustrative embodiment, will be described specifically hereinafter. As shown in FIG. 26, the agitating member 50 is made up of an elastic, generally U-shaped elastic plate 51 formed of resin and relatively thin and a relatively thick, heavy top plate 52 formed of resin, metal or similar material. The open end of the U-shaped elastic plate 51 is formed integrally with the mouth portion of the outlet 31*k* while the other end or tie portion of the plate 51 is formed integrally with the top plate 51. The agitating member 50 is so positioned as to cross the outlet 31*k* in the lengthwise direction of the reinforcing plate 31*f*. FIG. 29 shows a specific configuration of the toner discharging device 330 including the agitating member 50. While the toner discharging device 330 includes two agitating members 50 positioned at both ends of the outlet 31*k* substantially perpendicularly to the reinforcing plate 31*f*, the crux is that one or more agitating members 50 be positioned in the toner cartridge 31.

The agitating members 50 serve to prevent the toner from stopping up the outlet 31*k*, as will be described hereinafter. As shown in FIG. 29, when the toner cartridge 31 is caused to move back and forth in directions B and C, the agitating members 50 move in a direction D. At this instant, the agitating members 50, each comprising the thin elastic plate 51 and heavy top plate 52, noticeably shake in interlocked relation to the shock applying means, agitating the toner present in the toner cartridge 31 and thereby preventing it from stopping up the outlet 31*k*. In addition, such simple agitating members 50 do not increase the cost of the toner discharging device.

The bag 31*a*, reinforcing plate 31*f*, mouth member 31*b* and agitating members 50 may be formed of the same material in the same manner as in the previous embodiments in order to facilitate recycling of the toner cartridge 31 while reducing transport cost. Although the amount of toner to be replenished to the developing device 20 via the outlet 31*k* is apt to vary because the volume of the toner in the flexible bag 31*a* is apt to become unstable, the agitating members 50 promote desirable delivery of the toner while preventing it from stopping up the outlet 31*k*.

The reinforcing plate 31*f* is significant for the same reason as described in relation to the previous embodiments. In addition, the reinforcing plate 31*f*, fitted on the bottom of the bag 31*a*, prevents the bag 31*a* from deforming in the direction of movement of the toner cartridge 31 to thereby obviate defective toner discharge ascribable to deformation.

The notch 31*i*, FIG. 26, is formed in the reinforcing plate 31*f* for the same purpose as in the previous embodiment although not described specifically in order to avoid redundancy. Again, an air filter, not shown, maybe fitted on the toner cartridge 31, if desired.

Figure 30A:
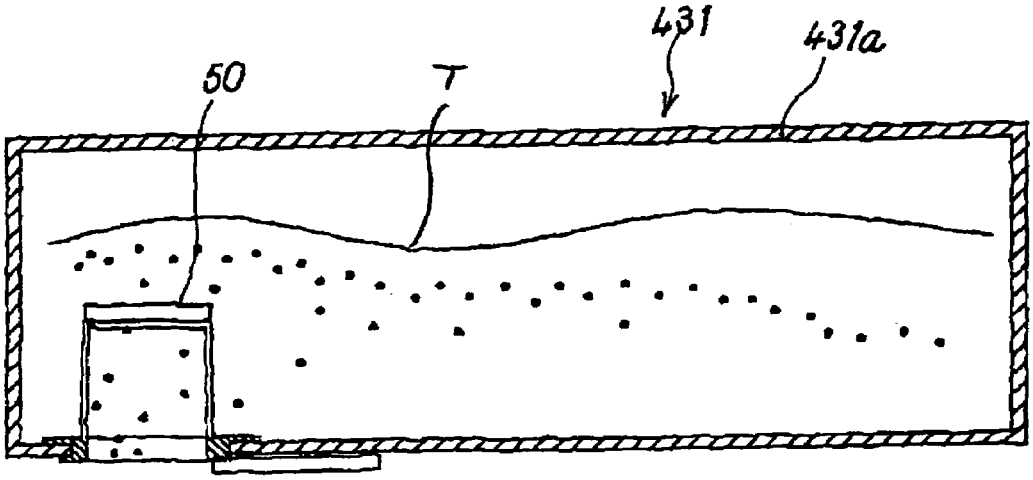
FIGS. 30A and 30B each show another specific configuration of the toner cartridge applicable to the third embodiment.

While the toner container 31 of the illustrative embodiment includes a flexible portion, it may be entirely formed of a rigid member, if desired. For example, FIG. 30A shows a toner container 431 implemented by a box 431*a* having thickness of 0.5 mm to 2 mm and formed of resin or similar hard material. Although such a hard toner container 431 occupies a substantial space when run out of toner, it can be easily mounted to the toner discharging device 30.

Figure 30B:
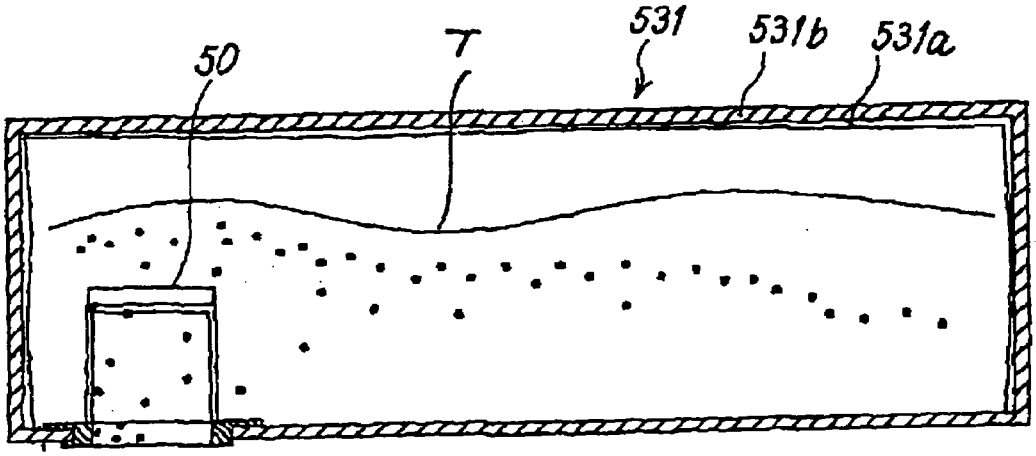

FIG. 30B shows another toner container 531 made up of a rigid box 531*b* and a flexible bag 531*a*, which is similar to the bag of the illustrative embodiment, accommodated in the box 531*b*. When the toner container 531 runs out of toner, only the bag 531*a* can be replaced and collected. This not only promotes easy handling in the event of collection and reduces space, but also allows the toner container 231 to be easily mounted to the toner discharging device 30.

In the illustrative embodiment, the agitating members 50 allows the toner to be stably discharged from the toner cartridge 31 without stopping up the outlet 31*k* without regard to the intensity of a shock exerted on the toner cartridge by the shock applying means or the size of the outlet 31*k*. This is because the agitating members 50, shaking in interlocked relation to the shock applying means, agitate the toner in the toner cartridge 31 to thereby obviate stop-up ascribable to, e.g., toner blocking. Further, the agitating members 50 allow the size of the outlet 31*k* to be reduced, so that smearing in the event of replacement of the toner cartridge 31 can be reduced.

Figure 31:
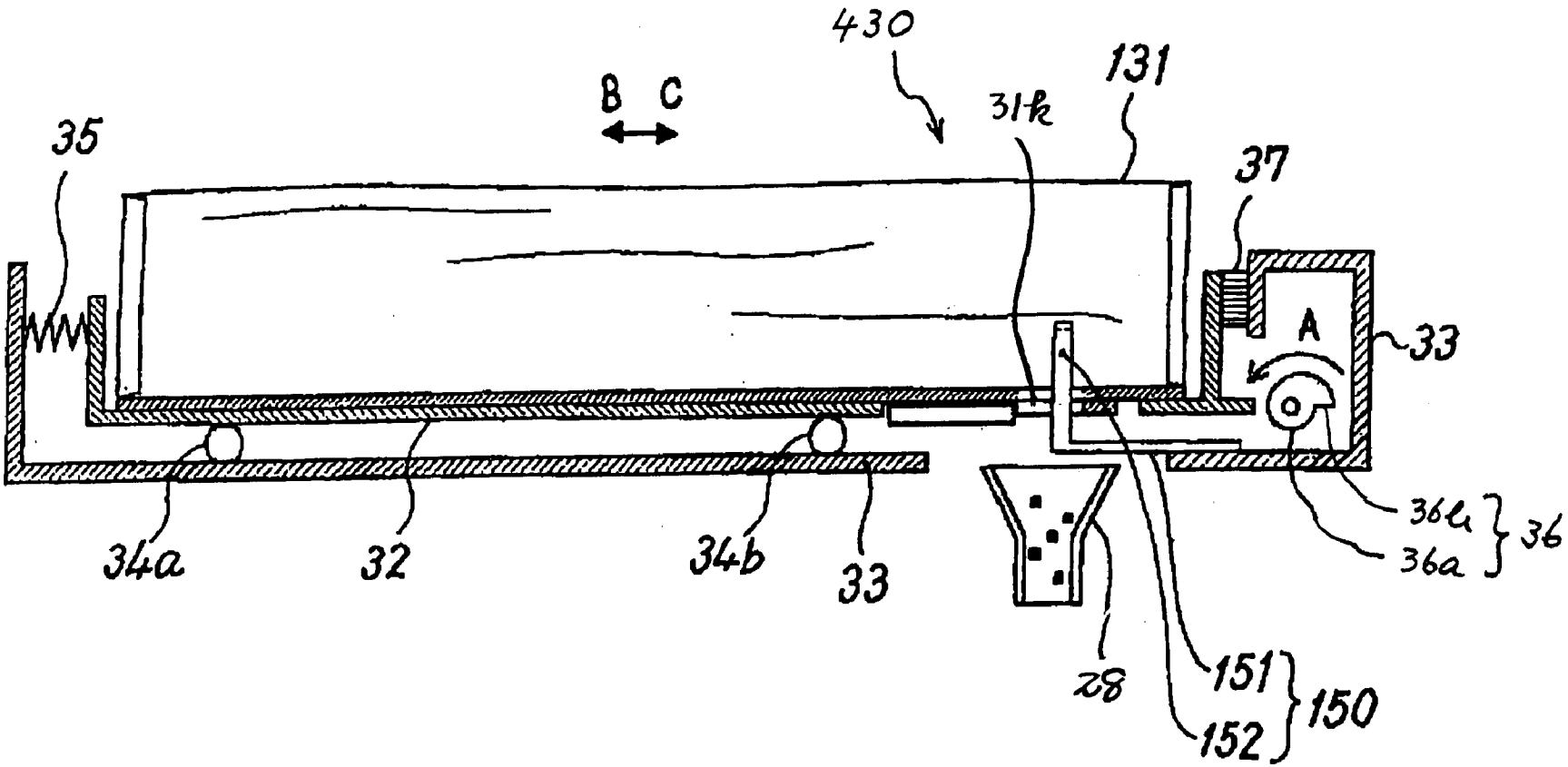
FIG. 31 shows another modification of the third embodiment.

FIG. 31 shows a modification of the illustrative embodiment of toner discharge device 430. As shown, the modification is identical with the illustrative embodiment except that the agitating members 50 are replaced with agitating members 150. The agitating members 150 are not included in the toner cartridge 31, but are connected to the support base 33. More specifically, the agitating members 150 each are generally L-shaped and affixed to the support base 33 at a base end 151 thereof. The other end of each agitating member 150 protrudes into the toner cartridge 131 via the outlet 31*k*. Although the agitating members 150, affixed to the support member 33, do not shake themselves, they successfully agitate the toner present in the toner cartridge 131 because the toner cartridge 131 is moved by the shock applying means. The agitating members 150 have a greater agitation stroke than the agitating members 50 of the illustrative embodiment and can therefore obviate stop-up more effectively than the agitating members 50.

Figure 32A:
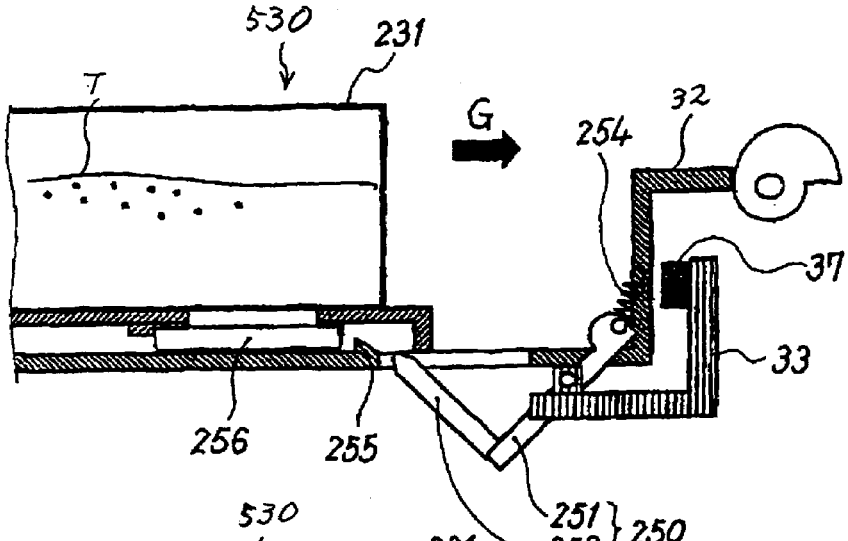
FIGS. 32A through 32C show still another modification of the third embodiment.
Figure 32B:
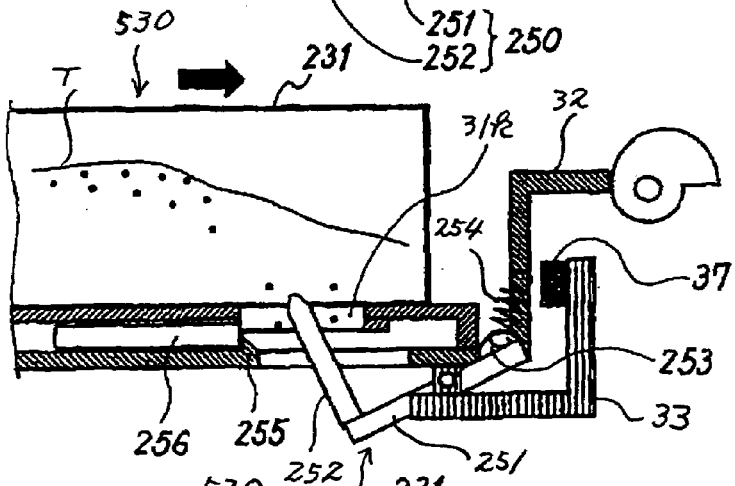
Figure 32C:
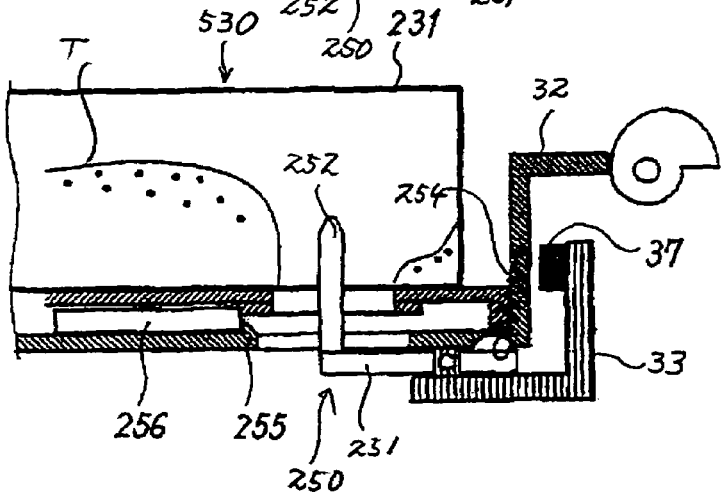

FIGS. 32A through 32C show another modification of the illustrative embodiment that includes means for causing the agitating members to selectively move into or out of the toner cartridge in interlocked relation to the mounting or dismounting of the toner cartridge. As shown, agitating members 250 are hinged to and therefore angularly movable relative to the support base 33 at a base end 251. As shown in FIG. 32A, when a toner cartridge 231 is being set along the support member 33 in the horizontal direction, the agitating members 250 are retracted below the holder 32 by tension springs 254, which are anchored to the holder 32, so as not to obstruct the movement of the toner cartridge 231. As shown in FIG. 32B, when the toner cartridge 231 is further moved rightward in a direction G, a lug 255 included in the holder 32 opens a shutter 256. At the same time, the toner cartridge 231 pushes the end portions 253 of the agitating member with the result that the agitating members 250 angularly move with their agitating portions 252 protruding into the outlet 31*k* of the toner cartridge 231.

FIG. 32C shows a condition in which the toner cartridge 231 is fully set in the toner discharging device 530. As shown, the agitating portions 252 of the agitating members 250 are entirely positioned in the toner cartridge 231.

Figure 33:
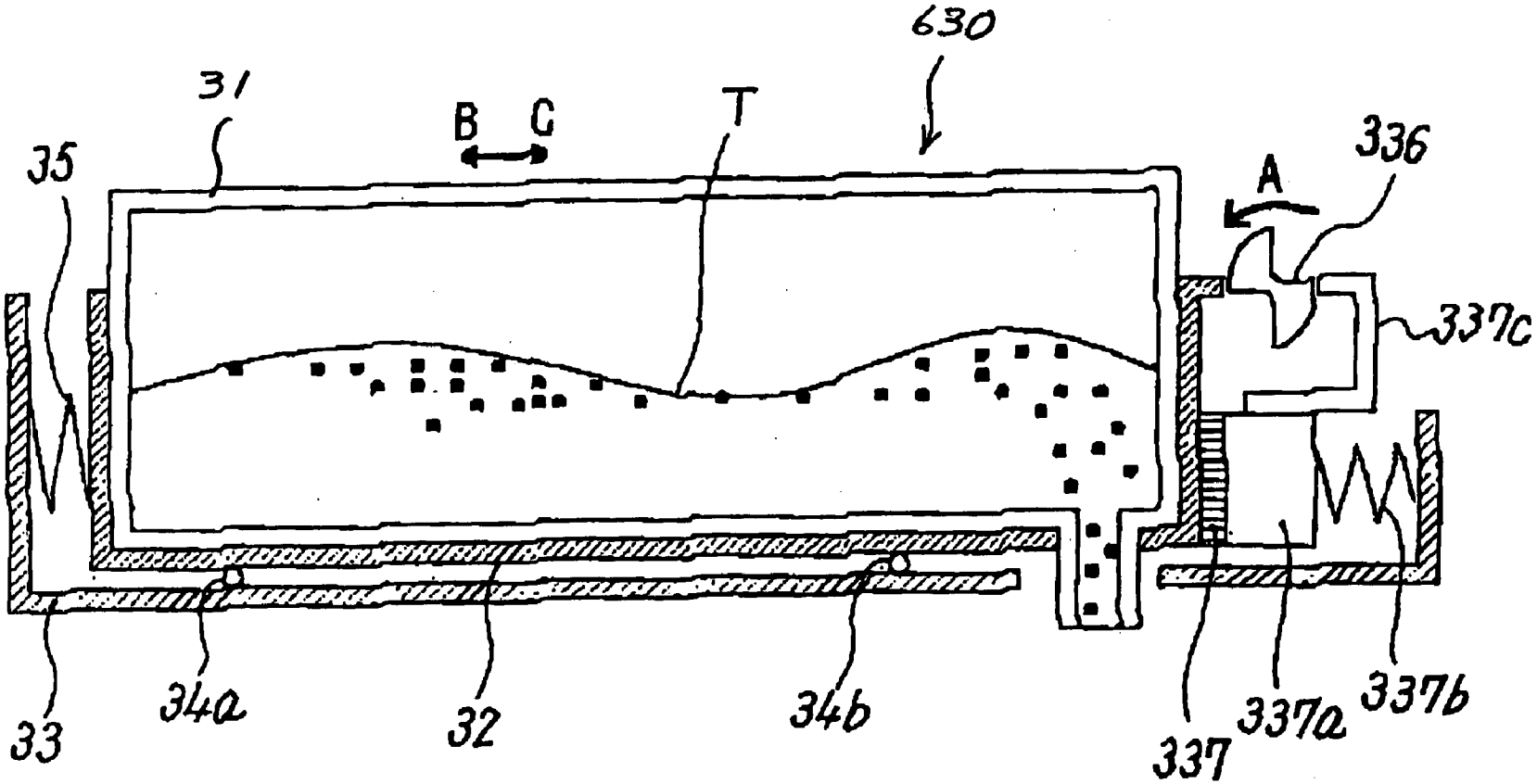
FIG. 33 shows a further modification of the third embodiment.

FIG. 33 shows a modification of any one of the embodiments shown and described. As shown, toner discharging means 630 includes a cam 336, a damper 337, a spring 337*b* and an arm 337*c* affixed to a damper support 337*a*. The cam 336 and damper 337 are configured and operated in essentially the same manner as in FIG. 15 and will not be described specifically in order to avoid redundancy.

It is to be noted that the agitating members shown and described are only illustrative and may be suitably modified in matching relation to, e.g., the desired toner agitating effect and the production cost of parts.

As stated above, the illustrative embodiment desirably discharges toner or power from the toner or powder container with the agitating members, which shake in interlocked relation to the shock applying means, thereby preventing the toner from stopping up the outlet of the container.

Various modifications will become possible for those skilled in the art after receiving the teachings of the present disclosure without departing from the scope thereof.

What is claimed is:

1. A powder discharging device comprising:

a powder container storing powder therein and including a bottom wall formed with an outlet at one end portion for discharging said powder vertically downward, said powder discharged via said outlet being replenished to a destination; and container moving means for moving said powder container toward the one end portion and then generating an acceleration opposite in direction to a movement of said powder container in said powder container to thereby cause the powder in said powder container to move toward said outlet;

wherein a maximum value of the acceleration is between 40 m/sec$^2$ and 200 m/sec$^2$, wherein a period of time for which said container moving means continuously generates an acceleration of 20 m/sec$^2$ or above is between 3 msec and 30 msec.

2. The device as claimed in claim 1, wherein a member, including said powder container and moved by said container moving means, has a total weight of 0.3 kgf or above, but 2 kgf or below, and wherein a speed variation of 0.1 m/sec or above, but 0.6 in/sec or below, occurs in said powder container when said container moving means is generating the acceleration in said powder container.

3. The device as claimed in claim 1, wherein said container moving means comprises reciprocating means for causing said powder container to move back and forth such that the movement toward the one end portion and generation of the acceleration repeatedly occur.

4. The device as claimed in claim 1, wherein said container moving means includes sudden stop means for causing said powder container moved to the one end portion to suddenly stop on hitting against said sudden stop means, said sudden stop means comprising a damper having a spring constant of 0.2 kg·f/mm or above, but 2 kg·f/mm or below.

5. The device as claimed in claim 4, wherein said damper is formed of rubber or gel whose hardness is between 0 and 20 in JIS (Japanese Industrial Standards)-A scale.

6. The device as claimed in claim 1, wherein said container moving means comprises sudden stop means for causing said powder container to suddenly stop by abutting against said powder container while moving in a direction opposite to a direction of the movement of said powder container, said sudden stop means comprising damper having a spring constant of 0.05 kg·f/mm or above, but 1 kg·f/mm or below.

7. The device as claimed in claim 6, wherein said damper is formed of rubber or gel whose hardness is between 0 and 20 in JIS (Japanese Industrial Standards)-A scale.

8. The device as claimed in claim 1, wherein at least the bottom wall of said powder container has rigidity high enough to prevent said bottom wall from deforming when subject to the deceleration while the other portion of said powder container is flexible enough to decrease in volume in accordance with a decrease in pressure in said toner container.

9. An image forming apparatus comprising:

a developing device configured to develop a latent image formed on an image carrier by depositing visible powder on said latent image; and a powder discharging device for replenishing the powder to said developing device;

said powder discharging device comprising:

a powder container storing the powder therein and including a bottom wall formed with an outlet at one end portion for discharging said powder vertically downward, said powder discharged via said outlet being replenished to said developing device; and container moving means for moving said powder container toward the one end portion and then generating an acceleration opposite in direction to a movement of said powder container in said powder container to thereby cause the powder in said powder container to move toward said outlet;

wherein a maximum value of the acceleration is between 40 m/sec$^2$ and 200 m/sec$^2$, wherein a period of time for which said container moving means continuously generates an acceleration of 20 m/sec$^2$ or above is between 3 msec and 30 msec.

10. The apparatus as claimed in claim 9, wherein the powder has a uniaxial breakdown stress of 15 g/cm$^2$ or below, as measured by a uniaxial breakdown stress measuring method.

11. A powder discharging device comprising:

a flexible powder container including a bottom wall formed with an outlet for discharging powder stored in said powder container and a rigid reinforcing plate affixed to an entirety of the bottom wall; and shock applying means for applying a shock to said powder container to thereby cause the powder to move toward said outlet and be discharged via said outlet;

wherein the powder has a mean circularity of 0.94 or above, but 1.00 or below, as measured by a flow-type particle image measuring device.

12. The device as claimed in claim 11, wherein the mean circularity is 0.96 or above.

13. The device as claimed in claim 11, wherein the powder is produced by polymerization.

14. The device as claimed in claim 11, wherein said powder container comprises a deformable bag storing the powder and a reinforcing member affixed to a bottom of said bag.

15. A powder discharging device comprising:

a powder container including a bottom wall formed with an outlet for discharging powder stored in said powder container; and shock applying means for applying a shock to said powder container to thereby cause the powder to move toward said outlet and be discharged via said outlet;

wherein the powder has a mean circularity of 0.94 or above, but 1.00 or below, as measured by a flow-type particle image measuring device, wherein said shock applying means applies the shock to said powder container by generating, while causing said powder container to move together with support means supporting said powder container, a speed variation of 0.1 m/sec or above, but 0.6 m/sec or below, and wherein said powder container and said support means have a total weight of 0.3 kgf or above, but 2 kgf or below.

16. A powder discharging device comprising:

a flexible powder container storing powder therein and including a bottom wall formed with an outlet for discharging said powder and a rigid reinforcing plate affixed to an entirety of the bottom wall; and shock applying means for applying a shock to said powder container to thereby cause the powder in said powder container to move toward said outlet and be discharged via said outlet;

wherein the powder has a mean circularity of 0.94 or above, but 1.00 or below, as measured by a flow-type particle image measuring device.

17. An image forming apparatus comprising:

a toner discharging device configured to discharge a powdery toner; and toner image forming means for forming a toner image with the toner discharged from said toner discharging device;

said toner discharging device comprising:

a flexible toner container including a bottom wall formed with an outlet for discharging the toner stored in said toner container and a rigid reinforcing plate affixed to an entirety of the bottom wall; and shock applying means for applying a shock to said toner container to thereby cause the toner to move toward said outlet and be discharged via said outlet;

wherein the toner has a mean circularity of 0.94 or above, but 1.00 or below, as measured by a flow-type particle image measuring device.

18. An image forming apparatus comprising:

a toner discharging device configured to discharge a powdery toner; and toner image forming means for forming a toner image with the toner discharged from said toner discharging device;

said toner discharging device comprising:

a flexible toner container storing the toner therein and including a bottom wall formed with an outlet for discharging said toner and a rigid reinforcing plate affixed to an entirety of the bottom wall; and shock applying means for applying a shock to said toner container to thereby cause the toner in said toner container to move toward said outlet and be discharged via said outlet;

wherein the toner has a mean circularity of 0.94 or above, but 1.00 or below, as measured by a flow-type particle image measuring device.

19. A powder discharging device comprising:

a powder container storing powder therein and including a bottom wall formed with an outlet for discharging said powder;

shock applying means for applying a shock to said powder container to thereby cause the powder in said powder container to move toward said outlet and be discharged via said outlet; and an agitating member configured to agitate the powder in interlocked relation to said shock applying means.

20. The device as claimed in claim 19, wherein said agitating member is formed integrally with a mouth portion of said outlet.

21. The device as claimed in claim 19, wherein said agitating member is supported by an elastic member.

22. The device as claimed in claim 19, wherein said agitating member is supported at an outside of said powder container and includes an agitating portion protruding into said powder container via said outlet.

23. The device as claimed in claim 22, wherein said agitating member includes means that selectively moves into or out of said toner container via said outlet.

24. The device as claimed in claim 19, wherein said powder container comprises a deformable bag storing the powder and a reinforcing member affixed to a bottom of said bag.

25. An image forming apparatus comprising:

a toner discharging device configured to discharge a powdery toner; and toner image forming means for forming a toner image with the toner discharged from said toner discharging device;

said toner discharging device comprising:

a toner container storing the toner therein and including a bottom wall formed with an outlet for discharging said toner;

shock applying means for applying a shock to said toner container to thereby cause the toner in said toner container to move toward said outlet and be discharged via said outlet; and an agitating member configured to agitate the toner in interlocked relation to said shock applying means.

* * * * *